US007017859B1

(12) United States Patent
Pascual

(10) Patent No.: US 7,017,859 B1
(45) Date of Patent: Mar. 28, 2006

(54) METHOD OF MAKING A MINIATURE, OPERABLE BOX KITE

(76) Inventor: Ricardo A. Pascual, 385 Tavernier Cir., Oldsmar, FL (US) 34677

( * ) Notice: Subject to any disclaimer, the term of this patent is extended or adjusted under 35 U.S.C. 154(b) by 0 days.

(21) Appl. No.: 10/996,029

(22) Filed: Nov. 23, 2004

(51) Int. Cl.
*B64C 31/06* (2006.01)

(52) U.S. Cl. ..... 244/153 R

(58) Field of Classification Search ..... 244/153 R, 244/153 A

See application file for complete search history.

(56) References Cited

U.S. PATENT DOCUMENTS 607,129 A * 7/1898 Potter ..... 244/153 R
927,965 A * 7/1909 Gruber ..... 244/153 R
1,744,529 A * 1/1930 De Haven ..... 244/155 R
1,908,325 A * 5/1933 De Haven ..... 244/153 R
2,533,570 A * 12/1950 Foy ..... 244/153 R
2,873,077 A * 2/1959 Corbin ..... 244/153 R
3,193,224 A * 7/1965 Williamson ..... 244/153 R
3,711,045 A * 1/1973 Holland, Jr. ..... 244/153 R
4,201,357 A * 5/1980 Gambardella ..... 244/153 R
4,640,476 A * 2/1987 Meckley ..... 244/155 R

* cited by examiner

*Primary Examiner*—Tien Dinh
(74) *Attorney, Agent, or Firm*—Ronald E. Smith

(57) ABSTRACT

A method for making a box kite includes the steps of placing two elongate strips of tissue paper atop a support surface in parallel relation to one another, separated by a third strip of stiff cardboard that maintains the parallel separation between them. The third strip is gradually withdrawn as elongate and truncate bamboo struts are adhered to the first and second strips of tissue in a particular pattern. A square parallelogram is then formed and strings and tails are secured to the kite. The kite is flattened, placed atop a flat thread card about which the main kite string and the tails are wrapped, and inserted into a package for sale.

19 Claims, 30 Drawing Sheets

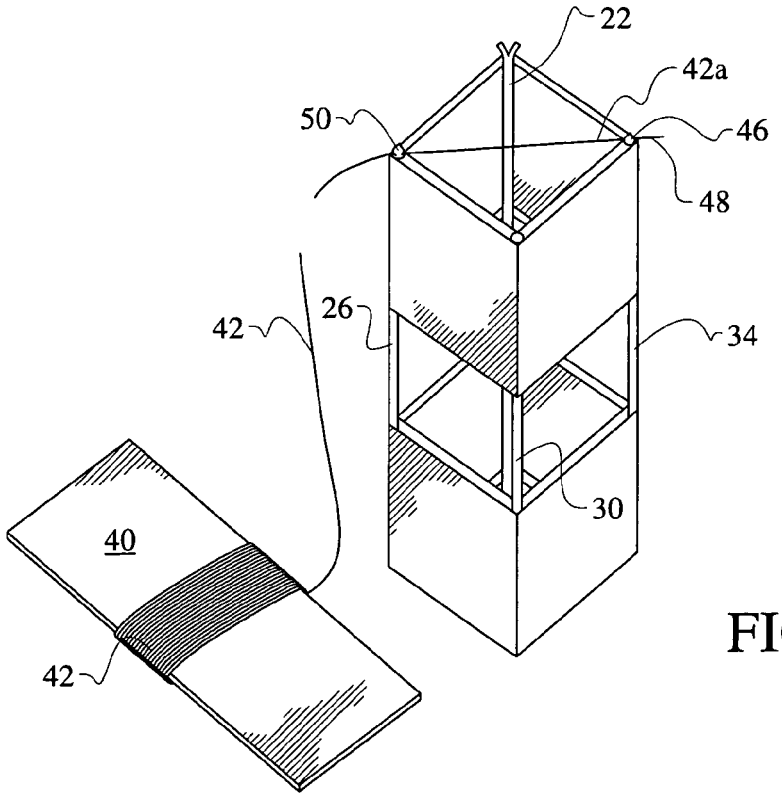
FIG. 24
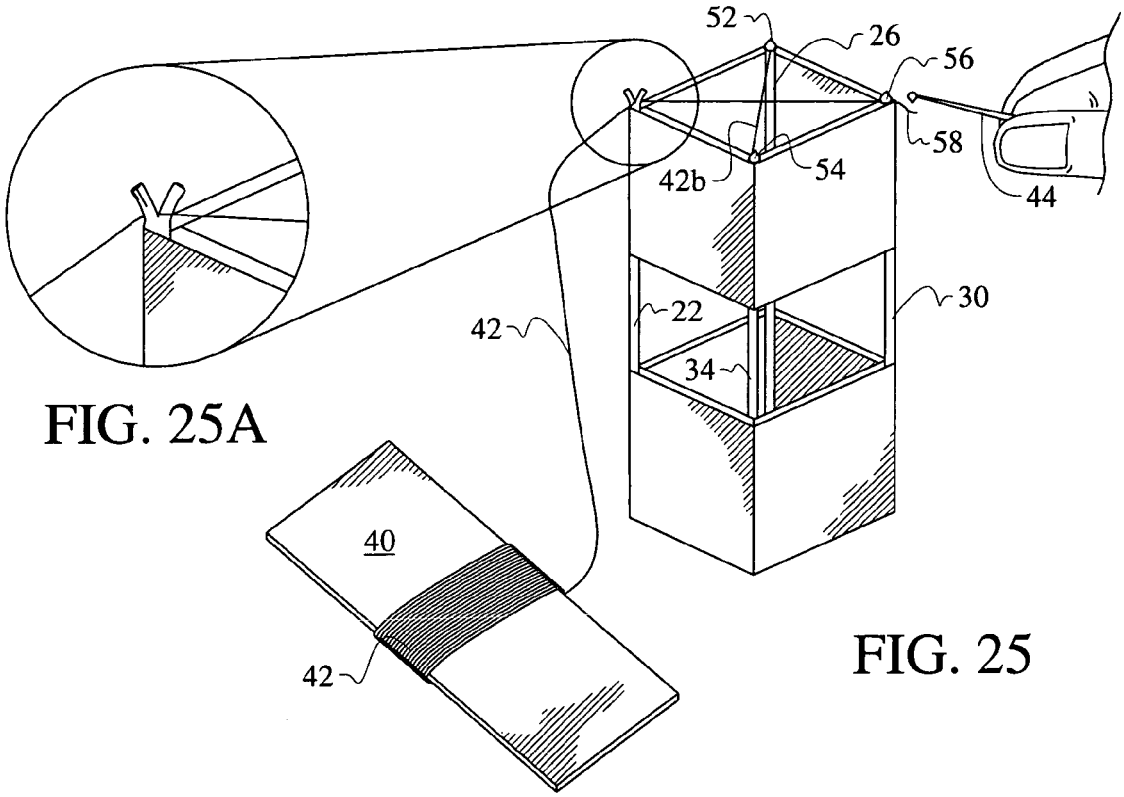
FIG. 25A
FIG. 25

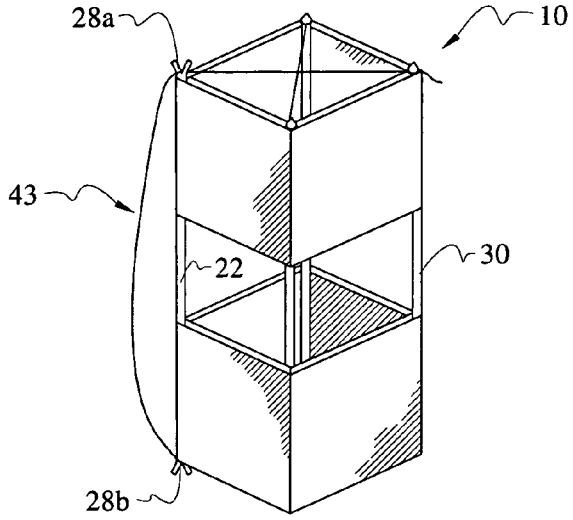
FIG. 30
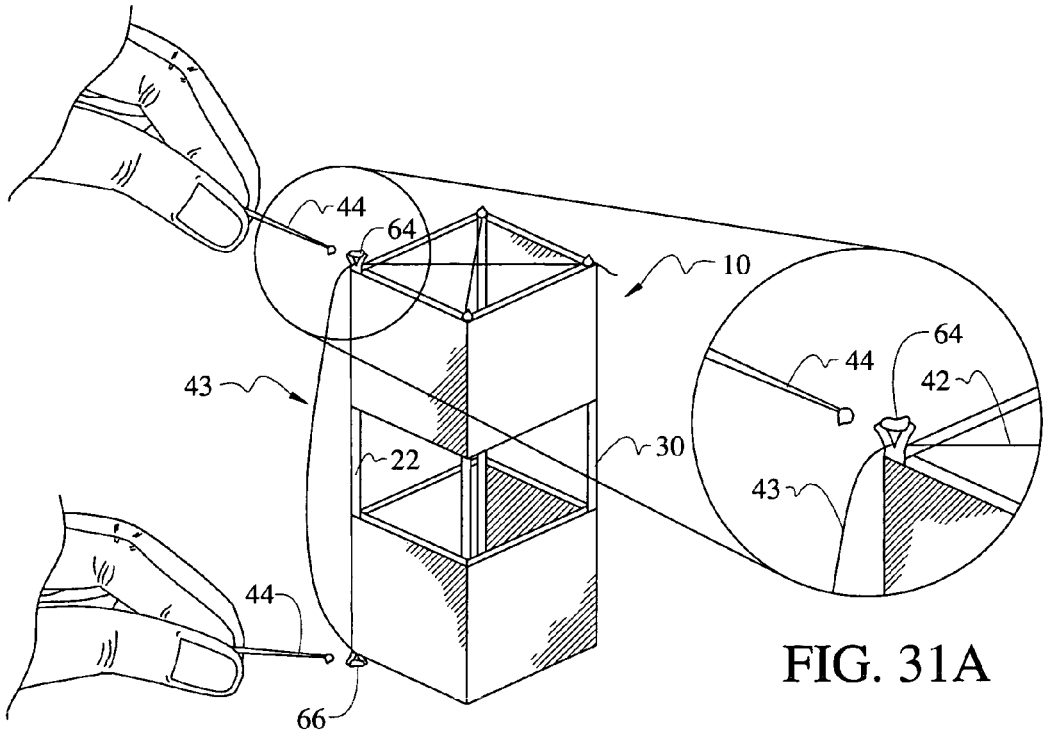
FIG. 31A
FIG. 31

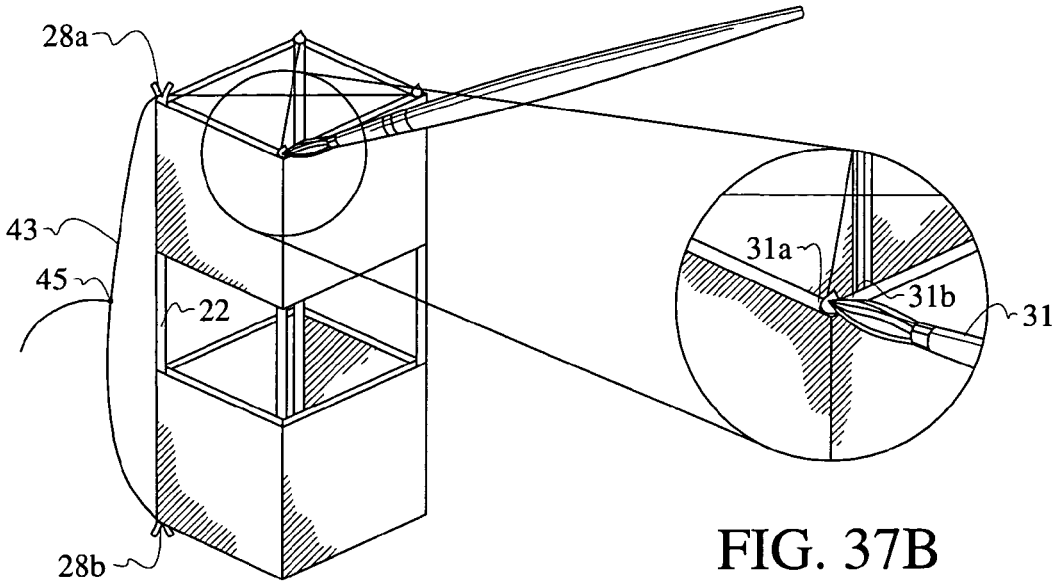
FIG. 37B
FIG. 37A
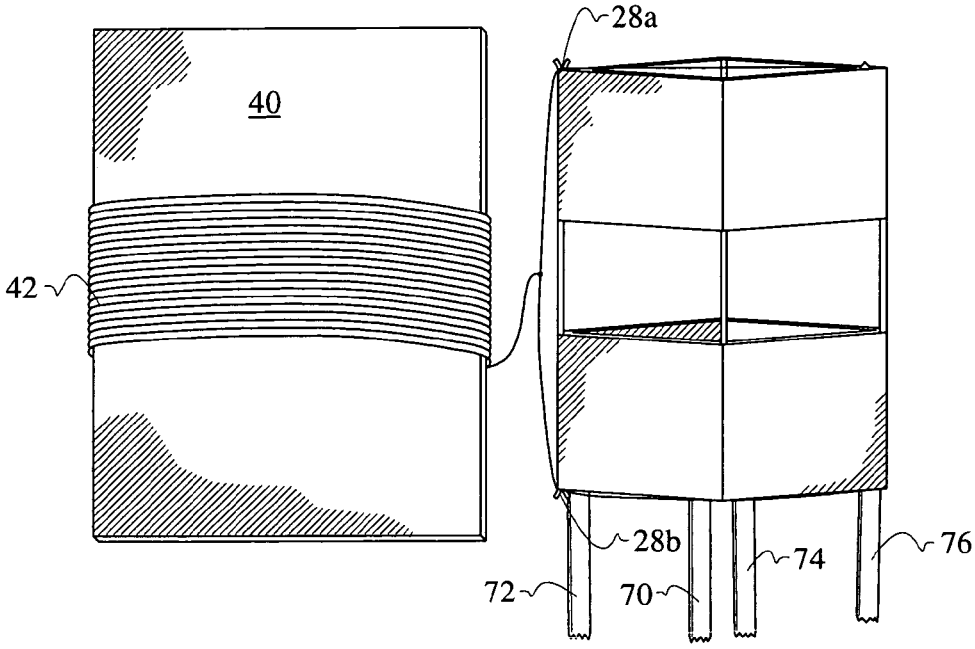
FIG. 38

METHOD OF MAKING A MINIATURE, OPERABLE BOX KITE

BACKGROUND OF THE INVENTION

1. Field of the Invention

This invention relates, generally, to box kites. More particularly, it relates to a miniature box kite and a method of making a miniature, operable box kite.

2. Description of the Prior Art

Full size box kites are well known. However, making a miniature, operable box kite that flies in very low wind conditions is not simply a matter of miniaturization of a full-size box kite.

However, in view of the prior art considered as a whole at the time the present invention was made, it was not obvious to those of ordinary skill in the pertinent art how a box kite could be miniaturized in an effective manner.

SUMMARY OF THE INVENTION

The long-standing but heretofore unfulfilled need for a method of making a miniature, operable box kite is now met by a new, useful, and non-obvious invention.

In performing the novel method, a first rectangular strip of tissue paper is positioned into overlying relationship to a flat support surface. A tissue separator template is positioned into abutting relation to a preselected longitudinal edge of the first strip of tissue paper and a first edge of the tissue separator template is aligned with a first edge of the first strip of tissue. A second rectangular strip of tissue paper having the same dimensions as the first strip of tissue paper is positioned against a bottom longitudinal edge of the tissue separator template. A first edge of the second strip of tissue paper is then aligned with the first edge of the tissue separator template. Respective opposite ends of the first strip of tissue paper and the second strip of tissue paper are secured to the flat support surface so that the tissue separator template is free to slide between them.

The tissue separator template is formed of a stiff rectangular piece of cardboard.

First, second, third and fourth elongate bamboo struts are provided. A "V"-shaped notch is formed in opposite ends of the first elongate bamboo strut.

The tissue separator template is slid a first time in a longitudinal direction away from the respective first edges of the first and second strips of tissue paper until the first edge of the tissue separator template is in a first position that is misaligned with the respective first edges of the first and second strips of tissue paper.

The first elongate bamboo strut is secured into overlying relation to the first and second strips of tissue paper in parallel and spaced apart relation to the respective first edges and in overlying relation to the first edge of the tissue separator template.

Four sets of truncate bamboo struts are provided where each set includes a first, second, third, and fourth truncate bamboo strut. The first and second truncate bamboo struts of the first set of truncate bamboo struts are secured to top and bottom longitudinal edges of the first strip of tissue paper so that their respective trailing ends are in abutting relation to the first elongate bamboo strut and so that the first and second truncate bamboo struts are disposed normal to the first elongate bamboo strut. The third and fourth truncate bamboo struts of the first set of truncate bamboo struts are secured to top and bottom longitudinal edges of the second strip of tissue paper so that the respective trailing ends of the third and fourth truncate bamboo struts of the first set of truncate bamboo struts are in abutting relation to the first elongate bamboo strut and so that the third and fourth truncate bamboo struts of the first set of truncate bamboo struts are disposed normal to the first elongate bamboo strut.

The tissue separator template is then slid a second time in a longitudinal direction away from the first elongate bamboo strut until the first edge of the tissue separator template is in a second position spaced justly slightly beyond respective leadings ends of the first, second, third, and fourth bamboo struts of the first set of truncate bamboo struts.

The second elongate bamboo strut is secured into overlying relation to the first and second strips of tissue paper in parallel and spaced apart relation to the first elongate bamboo strut and in overlying relation to the first edge of the tissue separator template. The first and second truncate bamboo struts of the second set of truncate bamboo struts are secured to top and bottom longitudinal edges of the first strip of tissue paper so that respective trailing ends of the first and second bamboo struts of the second set of truncate bamboo struts are in abutting relation to the second elongate bamboo strut and so that the first and second truncate bamboo struts of the second sets of truncate bamboo struts are disposed normal to the second elongate bamboo strut. The third and fourth truncate bamboo struts of the second set of truncate bamboo struts are secured to top and bottom longitudinal edges of the second strip of tissue paper so that respective trailing ends of the third and fourth truncate bamboo struts of the second set of truncate bamboo struts are in abutting relation to the second elongate bamboo strut and so that the third and fourth truncate bamboo struts of the second set of truncate bamboo struts are disposed normal to the second elongate bamboo strut.

The tissue separator template is slid a third time in a longitudinal direction away from the second elongate bamboo strut until the first edge of the tissue separator template is in a third position spaced justly slightly beyond respective leadings ends of the first, second, third, and fourth truncate bamboo struts of the second set of truncate bamboo struts.

The third elongate bamboo strut is secured into overlying relation to the first and second strips of tissue paper in parallel and spaced apart relation to the second elongate bamboo strut and in overlying relation to the first edge of the tissue separator template.

The first and second truncate bamboo struts of the third set of truncate bamboo struts are secured to top and bottom longitudinal edges of the first strip of tissue paper so that their respective trailing ends of the first and second bamboo struts of the third set of truncate bamboo struts are positioned in abutting relation to the third elongate bamboo strut and so that the first and second truncate bamboo struts of the third set of truncate bamboo struts are disposed normal to the third elongate bamboo strut. The third and fourth truncate bamboo struts of the third set of truncate bamboo struts are secured to top and bottom longitudinal edges of the second strip of tissue paper so that their respective trailing ends are positioned in abutting relation to the third elongate bamboo strut and so that the third and fourth truncate bamboo struts of the third set of truncate bamboo struts are disposed normal to the third elongate bamboo strut.

The tissue separator template is slid a fourth time in a longitudinal direction away from the third elongate bamboo strut until the first edge of the tissue separator template is in a fourth position spaced justly slightly beyond respective leadings ends of the first, second, third, and fourth truncate bamboo struts of the third set of truncate bamboo struts.

The fourth elongate bamboo strut is secured into overlying relation to the first and second strips of tissue paper in parallel and spaced apart relation to the third elongate bamboo strut and in overlying relation to the first edge of the tissue separator template. The first and second truncate bamboo struts of the fourth set of truncate bamboo struts are secured to top and bottom longitudinal edges of the first strip of tissue paper so that respective trailing ends of the first and second bamboo struts of the fourth set of truncate bamboo struts are in abutting relation to the fourth elongate bamboo strut and so that the first and second truncate bamboo struts of the fourth set of truncate bamboo struts are disposed normal to the fourth elongate bamboo strut. The third and fourth truncate bamboo struts of the fourth set of truncate bamboo struts are secured to top and bottom longitudinal edges of the second strip of tissue paper so that their respective trailing ends are in abutting relation to the fourth elongate bamboo strut and so that the third and fourth truncate bamboo struts of the fourth set of bamboo struts are disposed normal to the fourth elongate bamboo strut.

The tissue separator template is then removed from its position between the first and second strips of tissue paper.

Folding the first and second strips of tissue paper into a square parallelogram configuration and securing the first and second strips of tissue paper so that they do not unfold forms the miniature, operable box kite. A thread is then secured to the box kite.

The first and second strips of tissue are separated from said support surface prior to the step of forming the box kite by folding the first and second strips of tissue paper into a square parallelogram configuration. That part of the first and second strips of tissue that extends beyond the first elongate bamboo strut is trimmed when the first and second strips of tissue are folded into the square parallelogram configuration.

The first, second, third and fourth elongate strips of bamboo are dimensioned to have a predetermined common length. The predetermined common length is such that a top and a bottom end of the first, second, third and fourth elongate strips of bamboo extend slightly beyond the top and bottom longitudinal edges, respectively, of the first and second strips of tissue when the first, second, third and fourth elongate strips of bamboo are secured into overlying relation thereto.

The respective top and bottom ends of the second, third, and fourth elongate strips of bamboo are trimmed so that the second, third, and fourth elongate strips of bamboo are flush with the top and bottom edges, respectively, of the first and second strips of tissue. The top and bottom ends of the first elongate strip of bamboo therefore extend slightly beyond the first and second longitudinal edges of the first and second strips of tissue.

An elongate length of thread is wrapped around a flat thread card having a generally rectangular configuration in transverse relation to a longitudinal extent thereof. A free end of the thread is secured to a top end of the fourth elongate bamboo strut. The thread is extended diagonally across a top end of the box kite and the thread is pulled to make it taut. The thread is secured to a top end of the second elongate bamboo strut. The thread is cut at a preselected point between the flat thread card and the second elongate bamboo strut. The box kite is inverted and a leading end of the thread from the flat thread card is secured to a bottom end of the second elongate bamboo strut. The thread is extended diagonally so that the thread extends to the bottom end of the fourth elongate bamboo strut. The diagonally disposed thread is pulled to make it taut and the diagonally disposed thread is secured to the bottom end of the fourth elongate bamboo strut. The thread is cut at a preselected point between the flat thread card and the fourth elongate bamboo strut.

An adjustable thread line is attached to the box kite by securing the leading end of the cut thread line to a bottom end of the third elongate bamboo strut. The adjustable thread line is extended diagonally so that the thread extends to the bottom end of the first elongate bamboo strut. The diagonally disposed thread is pulled to make it taut and the diagonally disposed thread is positioned in the "V"-shaped slot formed in the bottom end of the first elongate bamboo strut. Squeezing the box kite at the second and fourth elongate bamboo struts flattens it. The flattening causes the first and third elongate bamboo struts to move away from one another and causes the thread positioned in the "V"-shaped slot to slide therewithin.

The flattened box kite is placed on its side and the adjustable thread line is extended from the "V"-shaped slot formed in the bottom end of the first elongate bamboo strut to the "V"-shaped slot formed in the top end of the first elongate bamboo slot, leaving a predetermined amount of slack in the adjustable thread line. The adjustable thread line is extended from the "V"-shaped slot formed in the top end of the first elongate bamboo strut to a top end of the third elongate bamboo strut and pulled taut. The adjustable thread line is then pulled to the top end of the third elongate bamboo strut and cut at a preselected point between the top end of the third elongate bamboo strut and the flat thread card.

The flattened box kite is then opened into a square parallelogram configuration by pulling on the adjustable thread line between the "V"-shaped slot formed in the top end of the first elongate bamboo strut and the "V"-shaped slot formed in the bottom end of the first elongate bamboo strut. Next, the box kite is positioned in upstanding relation to the support surface. The adjustable thread line is positioned deep within the "V"-shaped slot formed in the top end of the first elongate bamboo strut and the "V"-shaped slot formed in the bottom end of the first elongate bamboo strut. A drop of glue is deposited atop each of the "V"-shaped slots to prevent the adjustable thread line from exiting the "V"-shaped slots while allowing the adjustable thread line to slide relative to the "V"-shaped slots.

A leading end of the thread line is secured to the adjustable thread line. Prior to securing the leading end of the thread line to the adjustable thread line, the adjustable thread line is pulled until it is taut and so that it forms a triangle where the angles thereof are forty, sixty-five and seventy-five degrees. The forty degree angle is formed where the adjustable thread line meets the top end of the first elongate bamboo strut, the sixty-five degree angle is formed where the adjustable thread line meets the bottom end of the first elongate bamboo strut, and the seventy-five degree angle is formed where the leading end of the thread line is secured to the adjustable thread line.

A plurality of tails is then attached to the box kite. The box kite is positioned onto its side with the first and fourth elongate bamboo struts positioned into overlying relation with the support surface. A leading end of a first tail is secured to the trailing end of the fourth truncate bamboo strut of the first set of truncate bamboo struts. The box kite is then rotated a first time until the first and second elongate bamboo struts are positioned into overlying relation with the support surface. A leading end of a second tail is secured to the trailing end of the fourth truncate bamboo strut of the second set of truncate bamboo struts. The box kite is then again rotated until the second and third elongate bamboo struts are positioned into overlying relation with the support surface. A leading end of a third tail is secured to the trailing end of the fourth truncate bamboo strut of the third set of truncate bamboo struts. The box kite is rotated a fourth time until the third and fourth elongate bamboo struts are positioned into overlying relation with the support surface and a leading end of a fourth tail is secured to the trailing end of the fourth truncate bamboo strut of the fourth set of truncate bamboo struts.

The box kite is then positioned in its upstanding configuration. At least one drop of adhesive is applied to each corner of the box kite where tissue and bamboo meet. The adjustable thread line is loosened and the box kite is flattened. The thread is wrapped around the flat thread card and the flattened box kite is positioned atop the thread card. The tails are wrapped about the thread card and the completed assembly is placed into a package.

An important advantage of this invention is that it provides a miniature, operable box kite that can be flown in very low winds and a highly novel method of making such box kite.

Another important advantage is that the box kite is made with easily obtainable materials.

Still another important advantage is that the box kite can be stored in a flattened configuration yet easily deployed into its operable configuration.

These and other important advantages and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 24 is a perspective view depicting the cutting of the thread;

FIG. 25 is a perspective view depicting the adhering of thread to a "V"-slot formed in FIG. 4C;

FIG. 30 is a perspective view depicting the pulling of the adjustable thread line into its final position;

FIG. 31 is a perspective view depicting the application of glue to the opposite ends of the adjustable thread line;

FIG. 31A is a detailed perspective view of the parts circled in FIG. 31;

FIG. 37A is a perspective view depicting the application of glue to all of the tissue corners of the box kite;

FIG. 37B is a detailed perspective view of the parts circled in FIG. 37A;

FIG. 38 is a perspective view depicting the flattening of the finished box kite;

DETAILED DESCRIPTION OF THE PREFERRED EMBODIMENT

Figure 1:
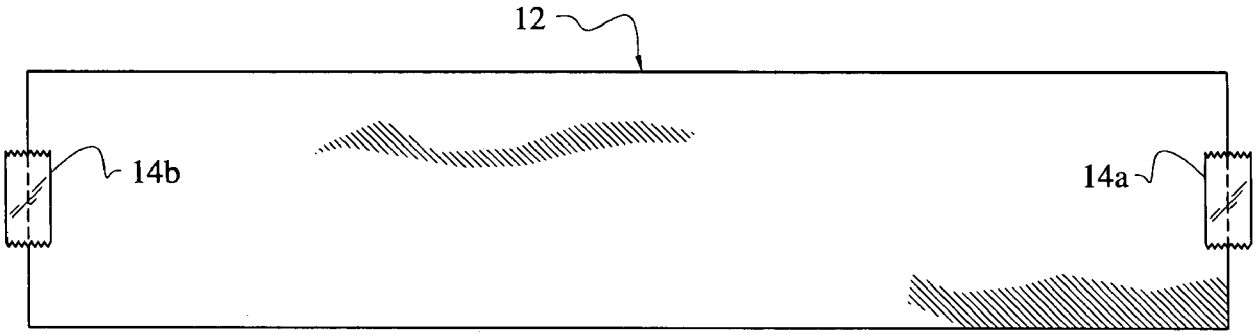
FIG. 1 is a top plan view of a strip of tissue paper taped to a support surface at its opposite ends.

Referring to FIG. 1, it will there be seen that the preferred work surface for making the novel box kite 10 (not depicted in FIG. 1) is a twelve inch by twelve inch (12"×12") Plexiglas® sheet 11. In the alternative, an aluminum sheet of the same size is acceptable.

A first strip of tissue paper 12 having the preferred dimensions of one and five-eighths inches (1⅝") in width and eight inches (8") in length is placed into overlying relationship to sheet 11 of Plexiglas or aluminum, and a pressure sensitive tape 14*a*, 14*b* is applied to the opposite ends of said strip of tissue paper.

Figure 2:
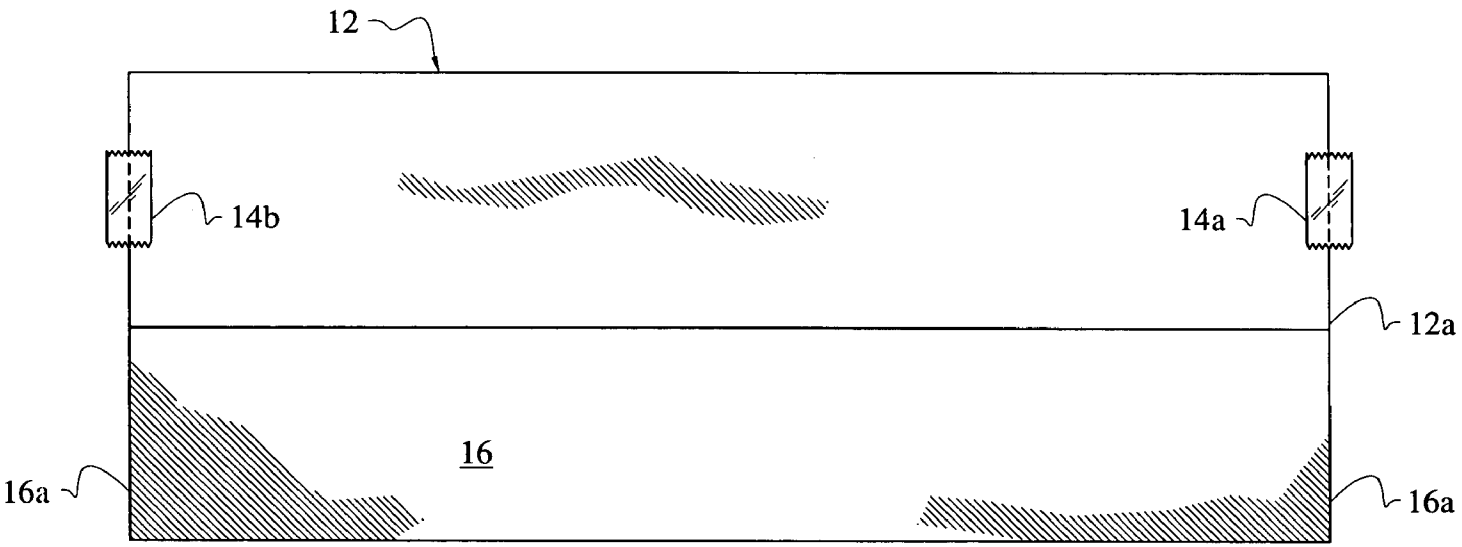
FIG. 2 is a top plan view like FIG. 1 but adding a tissue separator template.

As depicted in FIG. 2, tissue separator template 16, also preferably eight inches (8") in length, is placed into abutting relation to a preselected longitudinal edge of tissue paper 12. Right edge 16*a* of template 16 is aligned with right edge 12*a* of tissue 12.

The width of template 16 is one and one-eighth inches (1⅛").

A second strip of tissue paper 18 (FIG. 3), having the same dimensions as first strip of tissue paper 12, is then placed against the longitudinal edge of template 16. Edge 18*a* is placed into alignment with edge 16*a* of template 16 and pressure sensitive tape 20*a*, 20*b* is used to secure second strip 18 against movement.

The combined width of first strip 12, template 16, and second strip 18 is four and three-eighths inches (4⅜").

Template 16 ensures that first and second strips 12 and 18 remain in fixed, spaced apart relation to one another throughout the remaining steps of the method, thereby ensuring an even, square box kite.

Figure 4A:
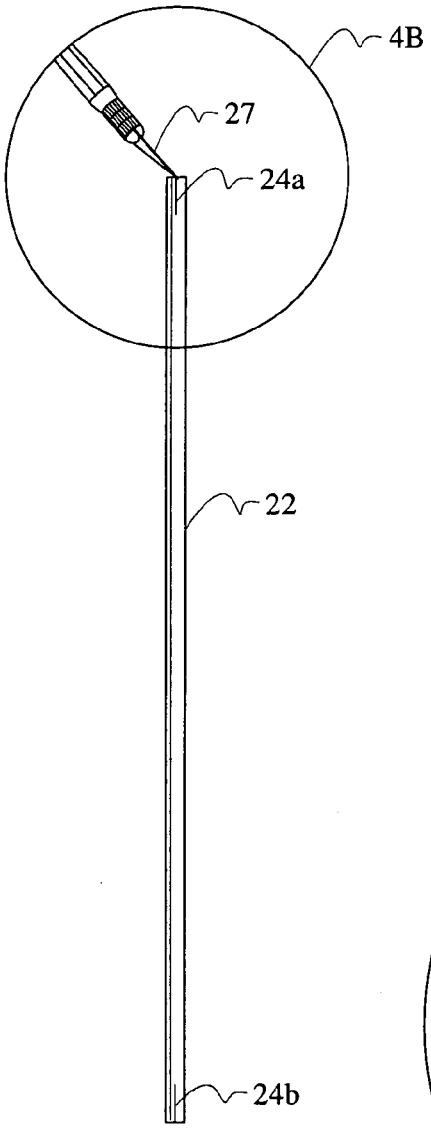
FIG. 4A is a side elevational view of a bamboo strut.

A first elongate bamboo strut 22, four and nine-sixteenth inches (4 9/16") in length, is illustrated in FIG. 4A. First elongate bamboo strut 22 is cut at its opposite ends as at 24*a*, 24*b* by a very sharp knife such as an Exacto® knife. The cut is one-eighth inch (⅛") in depth and is made at the exact center of each end.

Figure 4B:
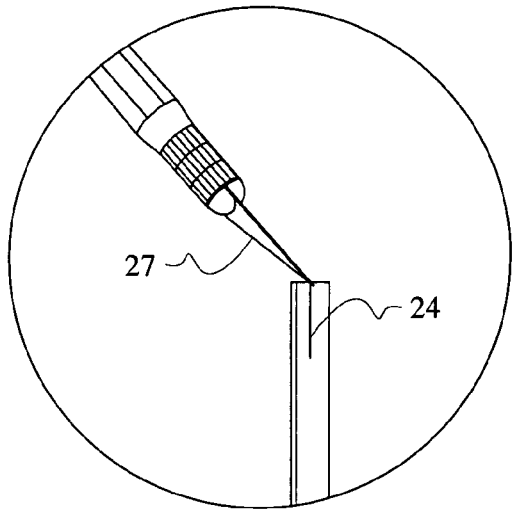
FIG. 4B is an enlarged view of the circled area denoted 4B in FIG. 4A.
Figure 4C:
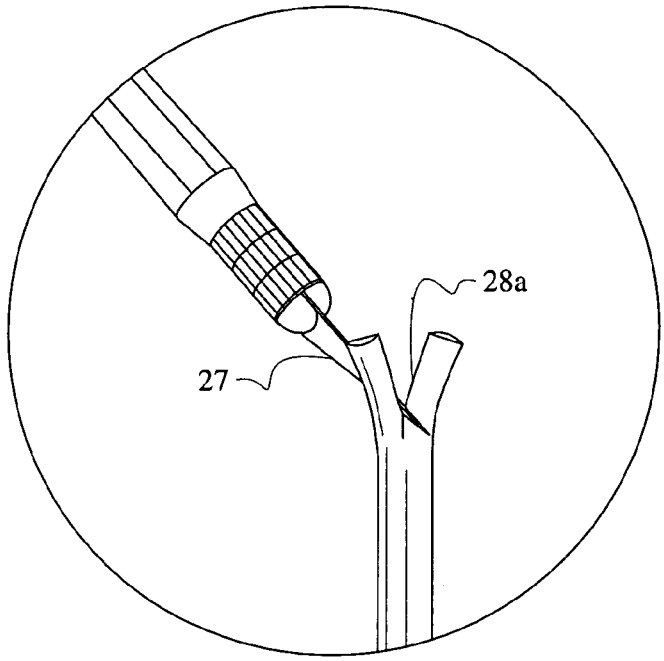
FIG. 4C is a perspective view of a knife forming a V slot in one end of the bamboo strut of FIG. 4B.

FIG. 4B is a detailed view depicting cut line 24 and knife blade 26 in greater detail and FIG. 4C depicts "V"-shaped slot 28*a* that is formed when a cut is made along cut line 24*a*.

Figure 5:
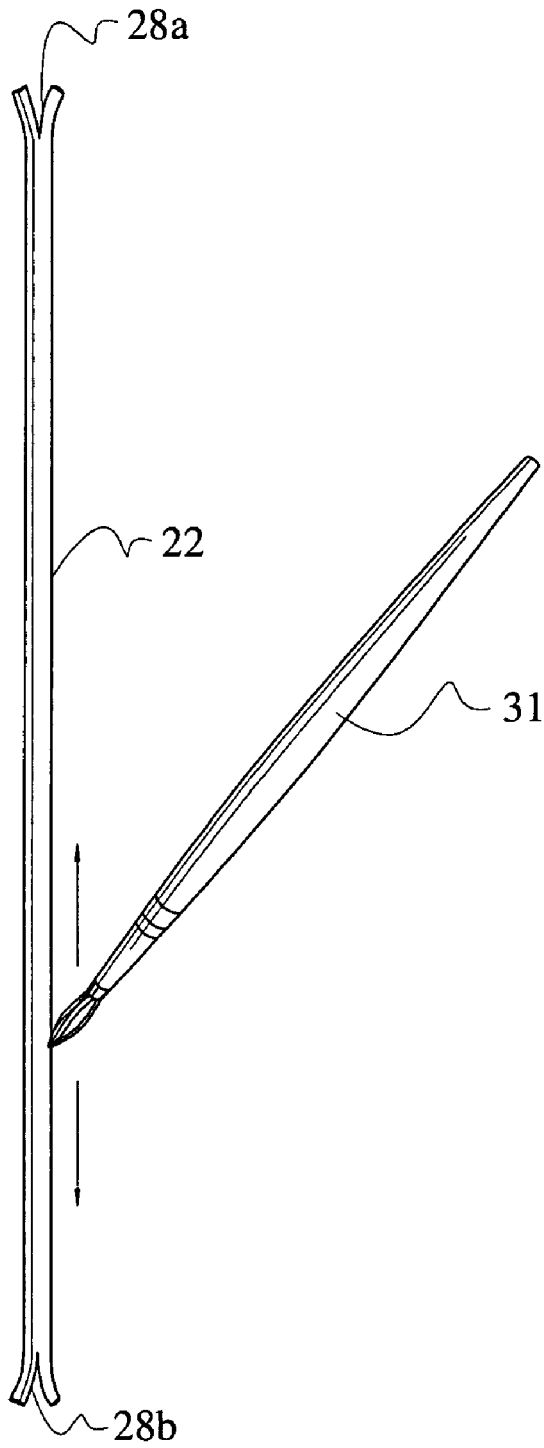
FIG. 5 is a side elevational view of a bamboo strut having a V slot formed on its opposite ends, depicting how an adhesive is applied to said bamboo strut.

A similar "V"-shaped slot 28*b*, depicted in FIG. 5, is formed in the opposite end of bamboo strut 22.

After "V"-shaped cuts 28*a* and 28*b* have been made, glue is applied along the length of first elongate bamboo strut 22 by brush 30 as indicated in FIG. 5. It is important that no glue is applied on or in said "V"-shaped slots 28*a*, 28*b*. If any glue is inadvertently applied to either or both of said locations, it must be wiped off immediately and if any glue has set it must be scraped off with a suitable blade.

Figure 3:
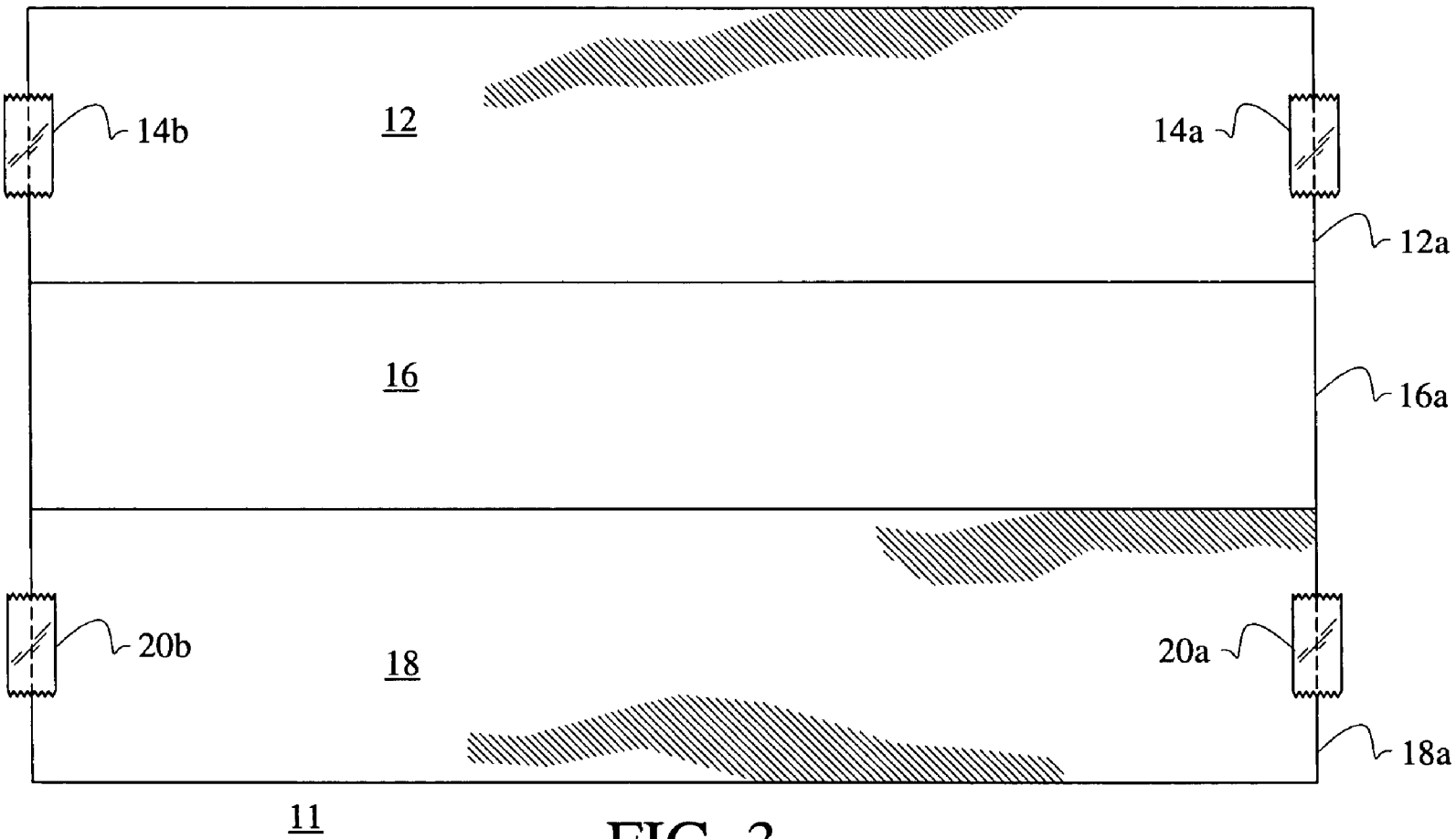
FIG. 3 is a top plan view like FIG. 2 but adding a second strip of tissue taped to a support surface at its opposite ends.
Figure 6:
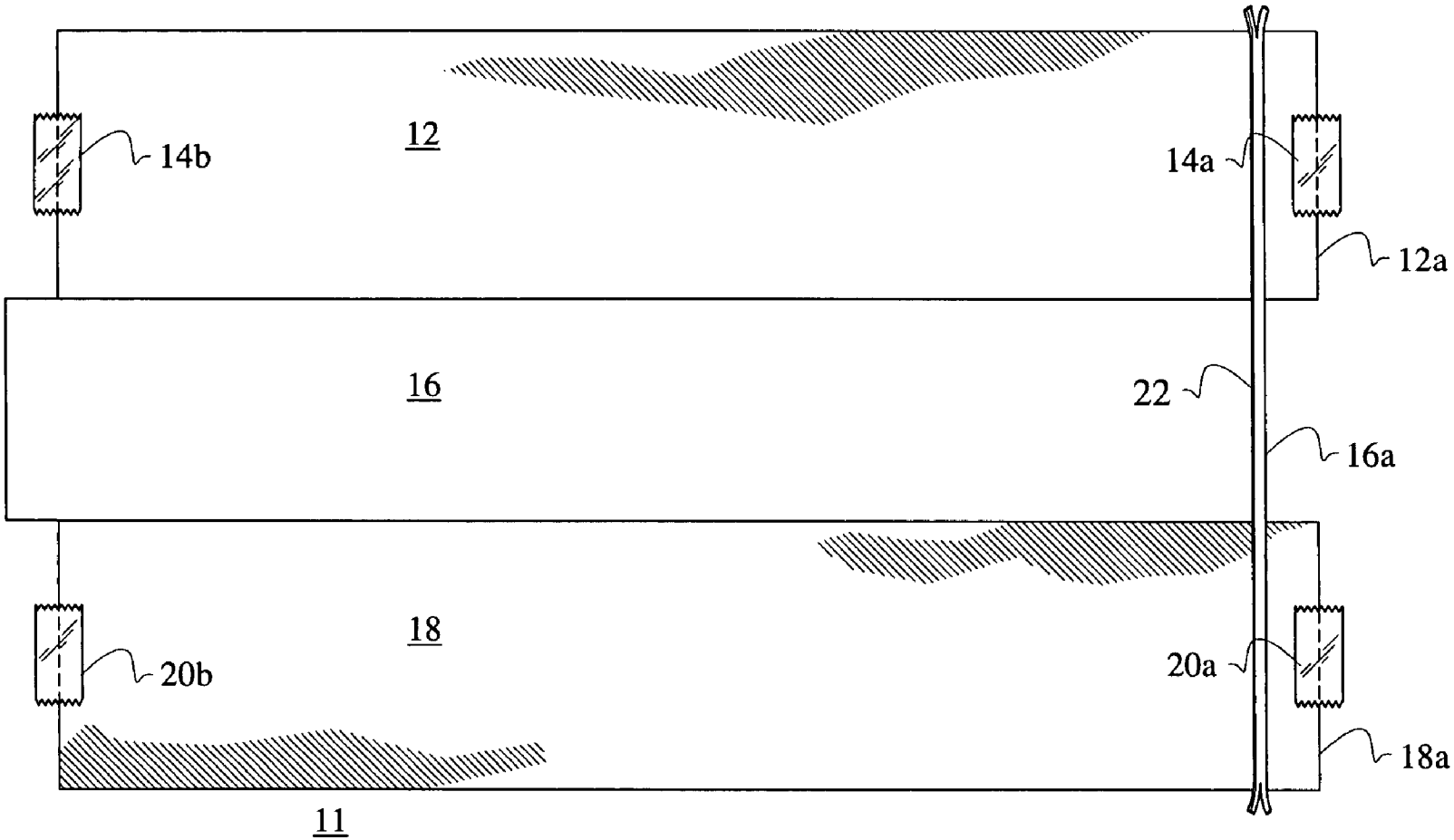
FIG. 6 is a top plan view like FIG. 3 but adding the bamboo strut of FIGS. 4A–C.
Figure 7:
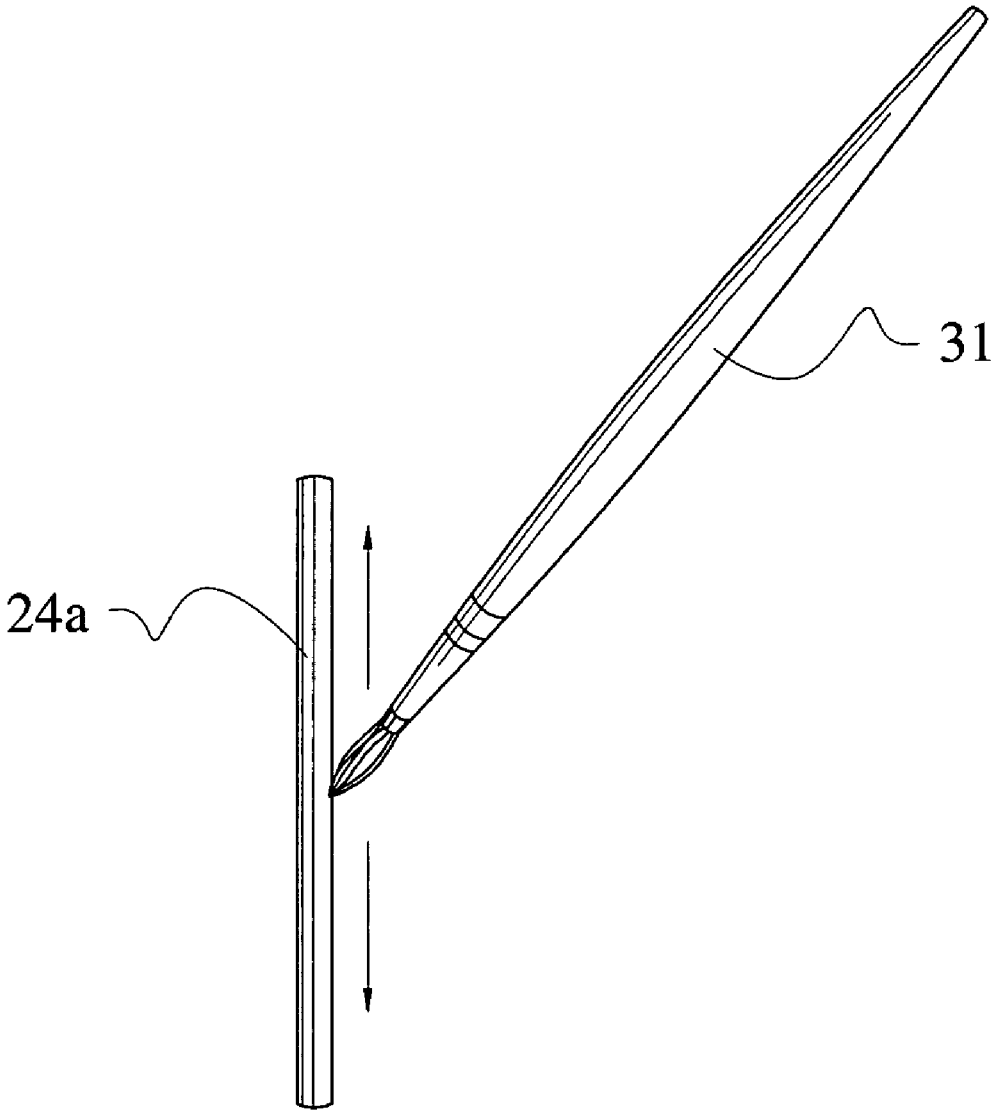
FIG. 7 is a side view of a truncate bamboo strut having adhesive applied thereto.
Figure 8:
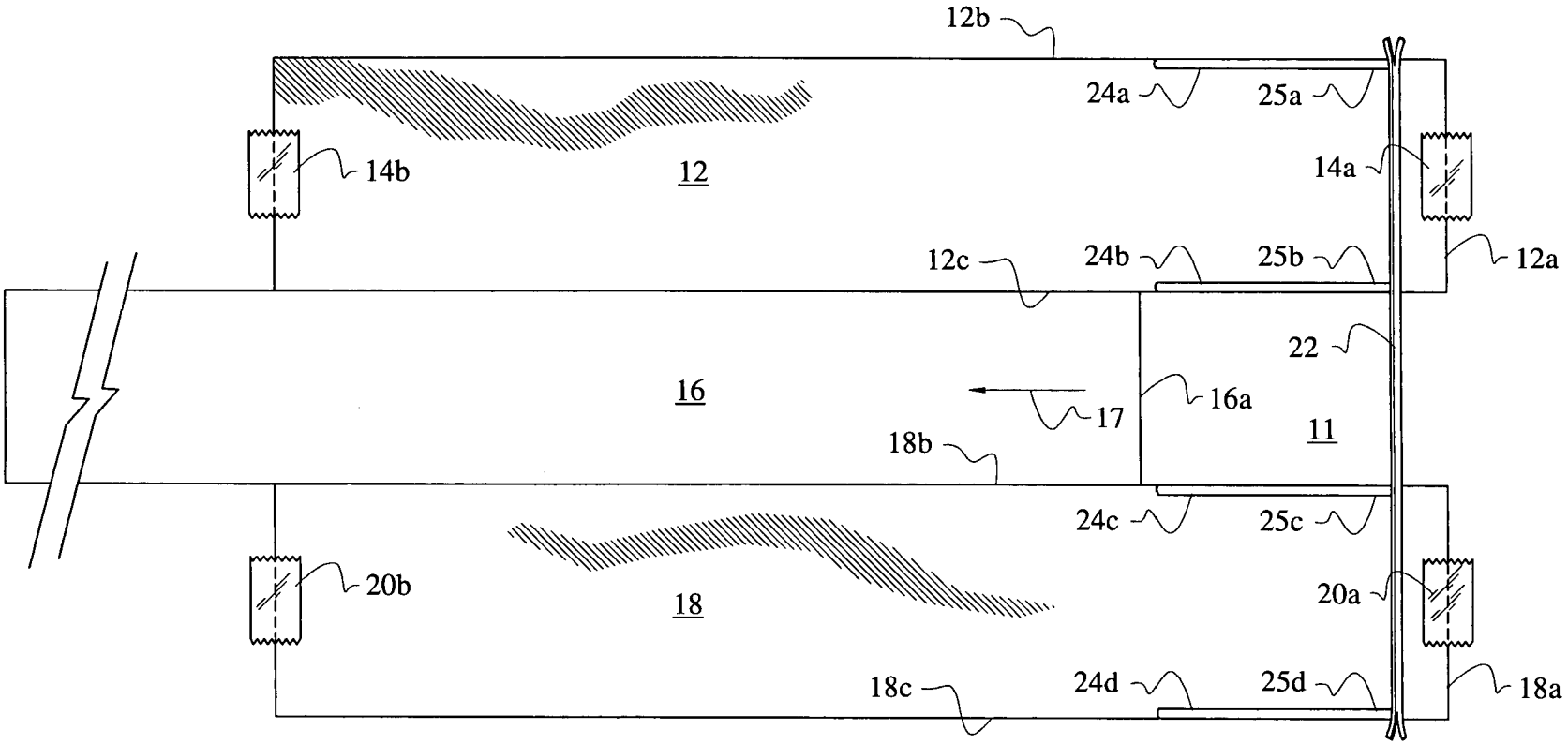
FIG. 8 is a top plan view like FIG. 6 but depicting a first displacement of the tissue separator template and depicting the placement of a first plurality of truncate bamboo struts.

Tissue separator template 16 is then slid a first time to the left, relative to its FIG. 3 position, about one-half inch (½") as depicted in FIG. 6. First elongate bamboo strut 22 is then positioned into overlying relation to first strip 12 and second strip 18 in parallel and spaced apart relation to edges 12*a*, 18*a* thereof. The spacing is about one-half inch (½") so that tape 14*b*, 20*b* does not interfere with placement of said first elongate bamboo strut. The opposite ends of first elongate bamboo strut 22 extend about three-thirty-seconds of an inch (3/32") beyond the respective outer longitudinal edges of first and second strips of tissue paper 12 and 18. First elongate bamboo strut 22 is positioned in alignment with right edge 16*a* of tissue separator template 16 to ensure that said first elongate bamboo strut 22 is squarely positioned with respect to strips of tissue paper 12 and 18, Adhesive is then applied by brush 31 to a first group of four truncate bamboo struts 24*a*, 24*b*, 24*c*, and 24*d*. The application of adhesive to one of said truncate bamboo struts is depicted in FIG. 7. The first group of four truncate bamboo struts is then positioned in the manner depicted in FIG. 8. More particularly, truncate bamboo struts 24*a*, 24*b* are deposited atop tissue strip 12 such that their respective trailing ends 25*a*, 25*b* are in abutting relation to first elongate bamboo strut 22 and so that said truncate bamboo struts 24*a*, 24*b* are disposed normal to said elongate bamboo strut 22. Moreover, said truncate bamboo struts 24*a*, 24*b* are coincident with the longitudinal upper and lower edges 12*b*, 12*c*, respectively, of strip of tissue paper 12. Similarly, truncate bamboo struts 24*c*, 24*d* are deposited atop strip of tissue paper 18 such that their respective trailing ends 25*c*, 25*d* are in abutting relation to first elongate bamboo strut 22 and so that said truncate bamboo struts 24*c*, 24*d* are disposed normal to said first elongate bamboo strut 22. Moreover, said truncate bamboo struts 24*c*, 24*d* are coincident with the longitudinal upper and lower edges 18*b*, 18*c*, respectively, of tissue strip 18.

Tissue separator template 16 is then displaced a second time to the left, relative to its FIG. 6 position, as indicated by single-headed directional arrow 17.

Figure 9:
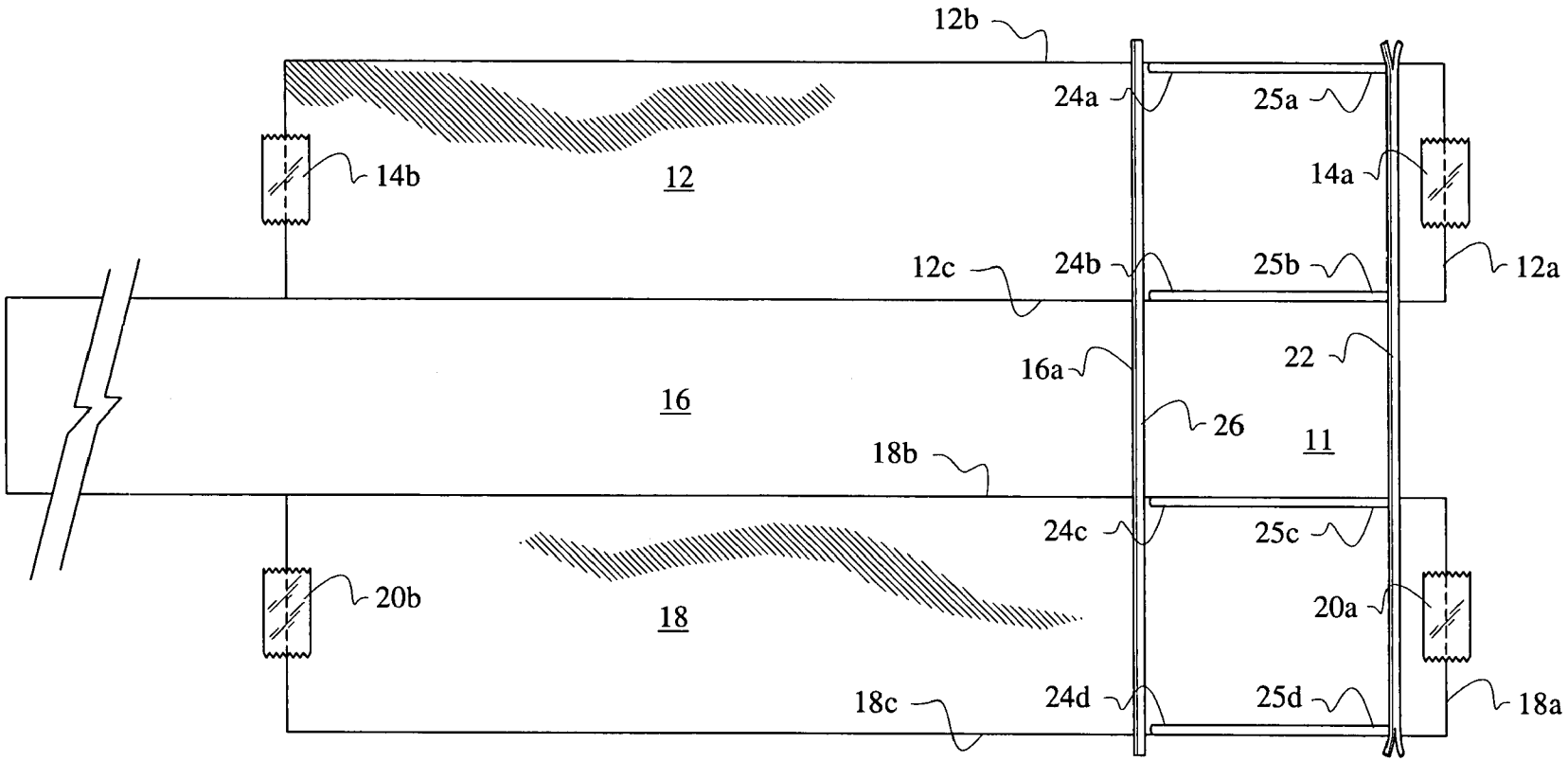
FIG. 9 is a top plan view like FIG. 8 but adding a second elongate bamboo strut.

Adhesive is then applied to a second elongate bamboo strut 26 and as depicted in FIG. 9, said second elongate bamboo strut 26 is positioned in parallel relation to first elongate bamboo strut 22, in spaced relation to the free ends of truncate bamboo struts 24*a*–*d*. Specifically, second elongate bamboo strut 26 is spaced one-sixty-fourth of an inch (1/64") from said free ends. Said second elongate bamboo strut 26 is positioned coincident with right edge 16*a* of tissue separator template 16 to ensure that second elongate bamboo strut 26 is squarely oriented with respect to first tissue strip 12 and second tissue strip 18.

Figure 10:
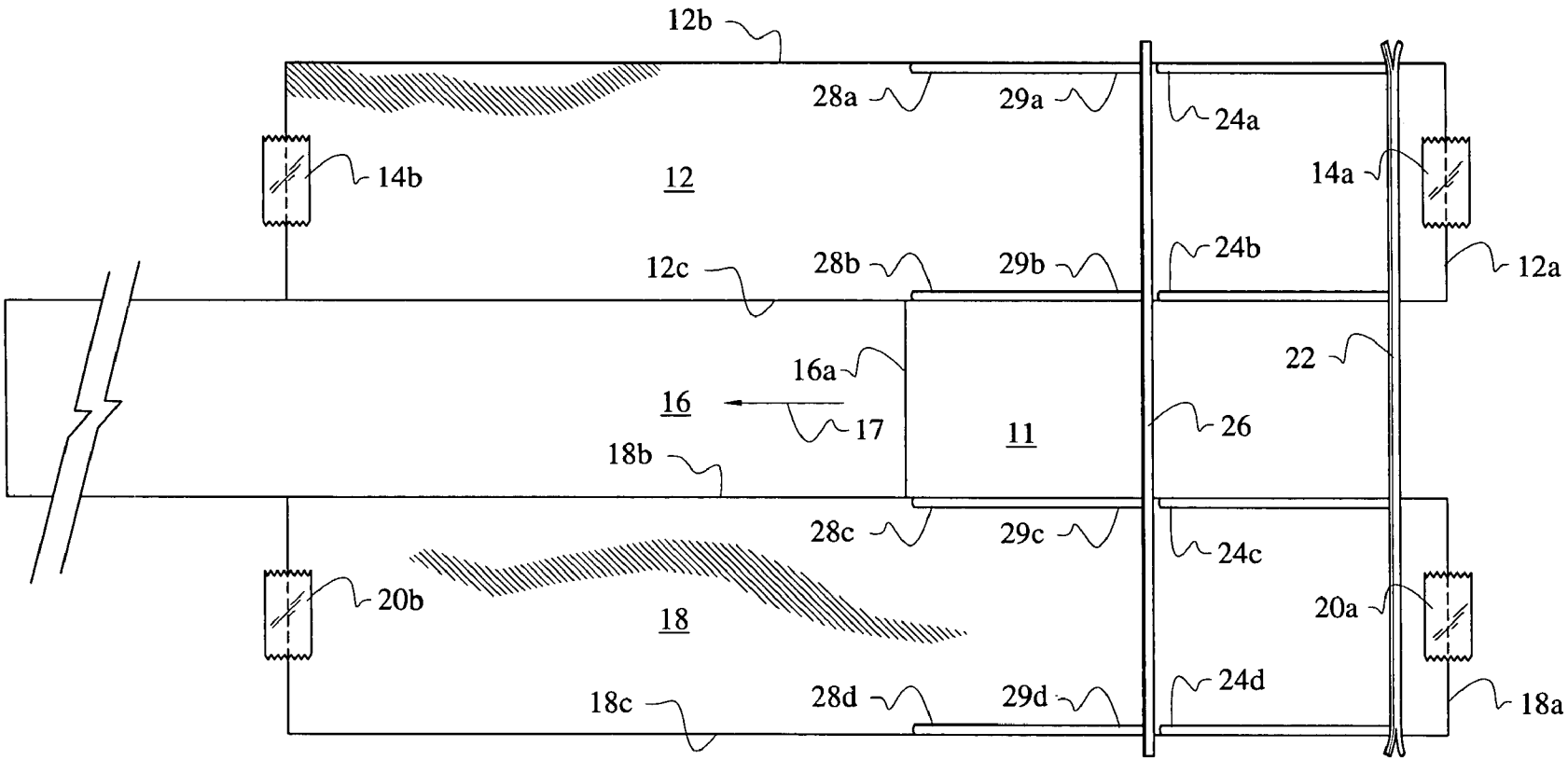
FIG. 10 is a top plan view like FIG. 8, but depicting a second displacement of the tissue separator template and adding a second plurality of truncate bamboo struts.

Adhesive is then applied in the same manner to a second group of four truncate bamboo struts 28*a*, 28*b*, 28*c*, and 28*d* and said second group of four truncate bamboo struts is then positioned in the manner depicted in FIG. 10. Truncate bamboo struts 28*a*, 28*b* are deposited atop tissue strip 12 such that their respective trailing ends 29*a*, 29*b* are in abutting relation to second elongate bamboo strut 26 and so that said truncate bamboo struts 28*a*, 28*b* are disposed normal to said second elongate bamboo strut 26. Moreover, said truncate bamboo struts 28*a*, 28*b* are coincident with the longitudinal upper and lower edges 12*b*, 12*c*, respectively, of tissue strip 12.

Similarly, truncate bamboo struts 28*c*, 28*d* are deposited atop tissue strip 18 such that their respective trailing ends 29*c*, 29*d* are in abutting relation to second elongate bamboo strut 26 and so that truncate bamboo struts 28*c*, 28*d* are disposed normal to second elongate bamboo strut 26. Moreover, truncate bamboo struts 28*c*, 28*d* are coincident with the longitudinal upper and lower edges 18*b*, 18*c*, respectively, of tissue strip 18.

Tissue separator template 16 is then displaced to the left a third time, relative to its FIG. 9 position, as indicated by single-headed directional arrow 17.

Figure 11:
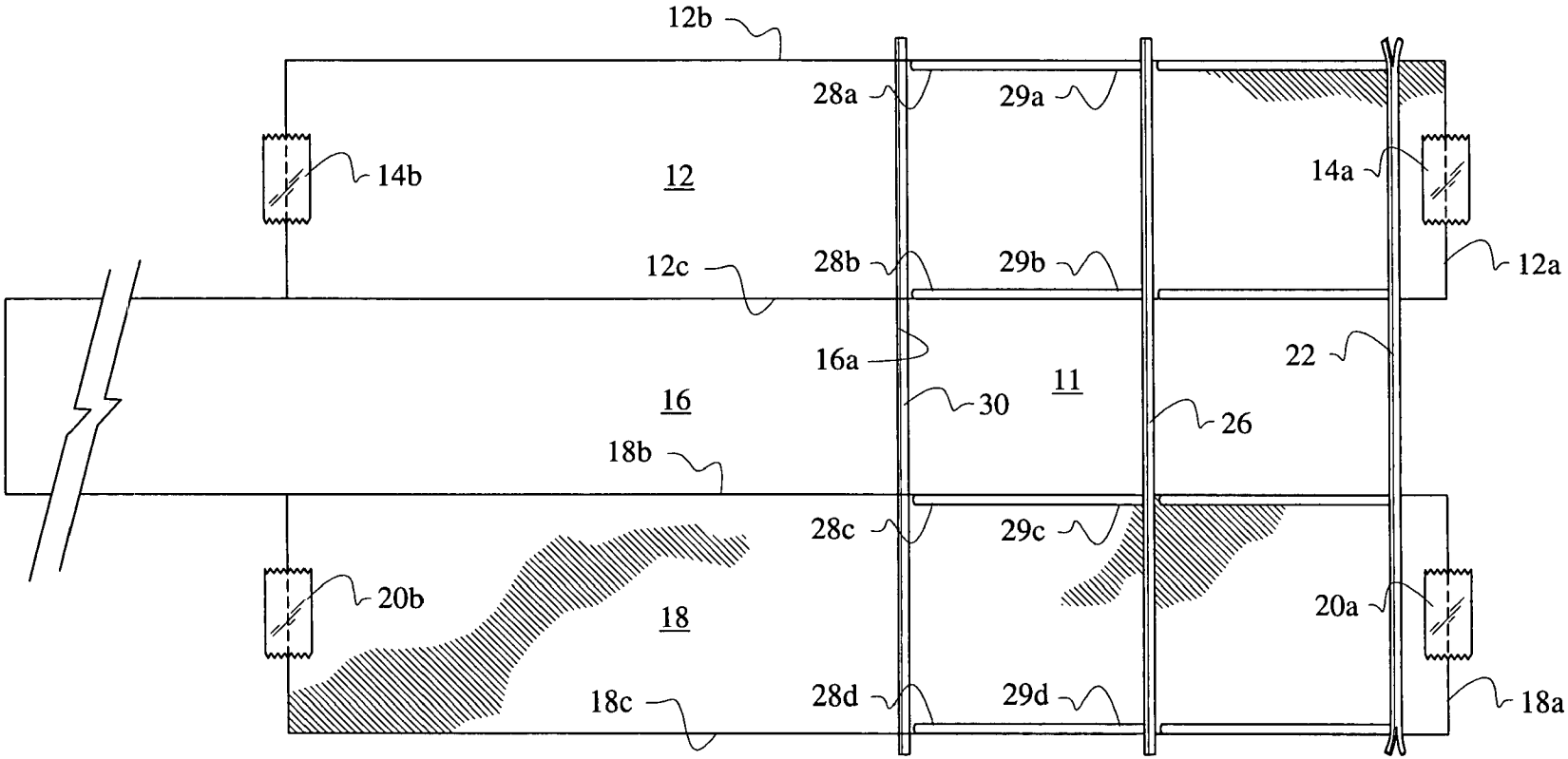
FIG. 11 is a top plan view like FIG. 10 but adding a third elongate bamboo strut.

Adhesive is then applied to a third elongate bamboo strut 30 and as depicted in FIG. 11, third elongate bamboo strut 30 is positioned in parallel relation to first and second elongate bamboo struts 22 and 26, in spaced relation to the free ends of truncate bamboo struts 28*a*–*d*. Specifically, third elongate bamboo strut 30 is spaced one-sixty-fourth of an inch (1/64") from said free ends. Third elongate bamboo strut 30 is positioned coincident with right edge 16*a* of tissue separator template 16 to ensure that third elongate bamboo strut 30 is squarely oriented with respect to first tissue strip 12 and second tissue strip 18.

Adhesive is then applied by brush to a third group of four truncate bamboo struts 32*a*, 32*b*, 32*c*, and 32*d*.

Figure 12:
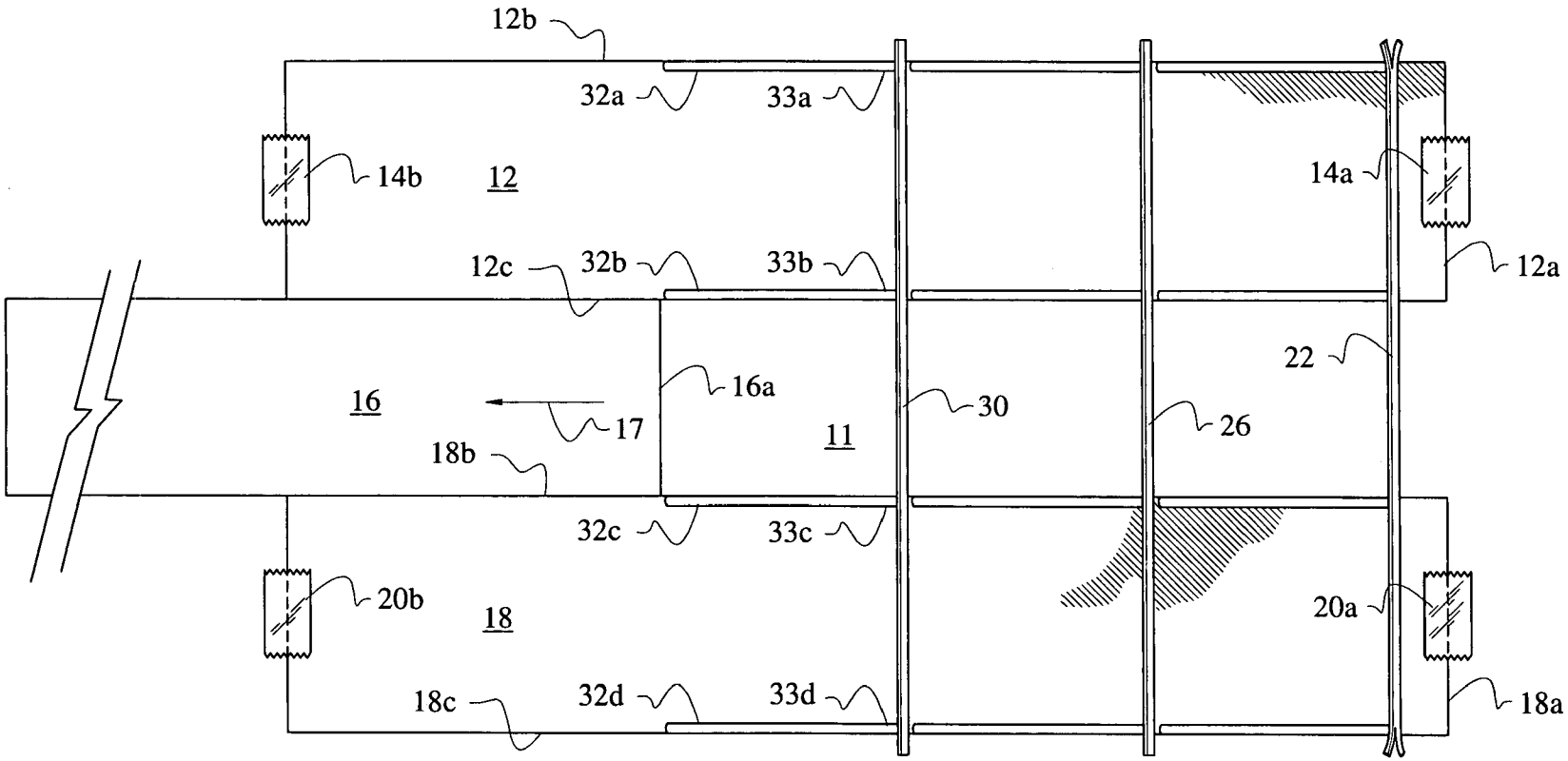
FIG. 12 is a top plan view like FIG. 11 but depicting a third displacement of the tissue separator template and adding a third plurality of truncate bamboo struts.

The third group of four truncate bamboo struts is positioned in the manner depicted in FIG. 12. Truncate bamboo struts 32*a*, 32*b* are deposited atop tissue strip 12 such that their respective trailing ends 33*a*, 33*b* are in abutting relation to third elongate bamboo strut 30 and so that said truncate bamboo struts 32*a*, 32*b* are disposed normal to said third elongate bamboo strut 30. Moreover, truncate bamboo struts 32*a*, 32*b* are coincident with the longitudinal upper and lower edges 12*b*, 12*c*, respectively, of tissue strip 12.

Similarly, truncate bamboo struts 32*c*, 32*d* are deposited atop tissue strip 18 such that their respective trailing ends 33*c*, 33*d* are in abutting relation to third elongate bamboo strut 30 and so that truncate bamboo struts 32*c*, 32*d* are disposed normal to third elongate bamboo strut 30. Moreover, truncate bamboo struts 32*c*, 32*d* are coincident with the longitudinal upper and lower edges 18*b*, 18*c*, respectively, of tissue strip 18.

Figure 13:
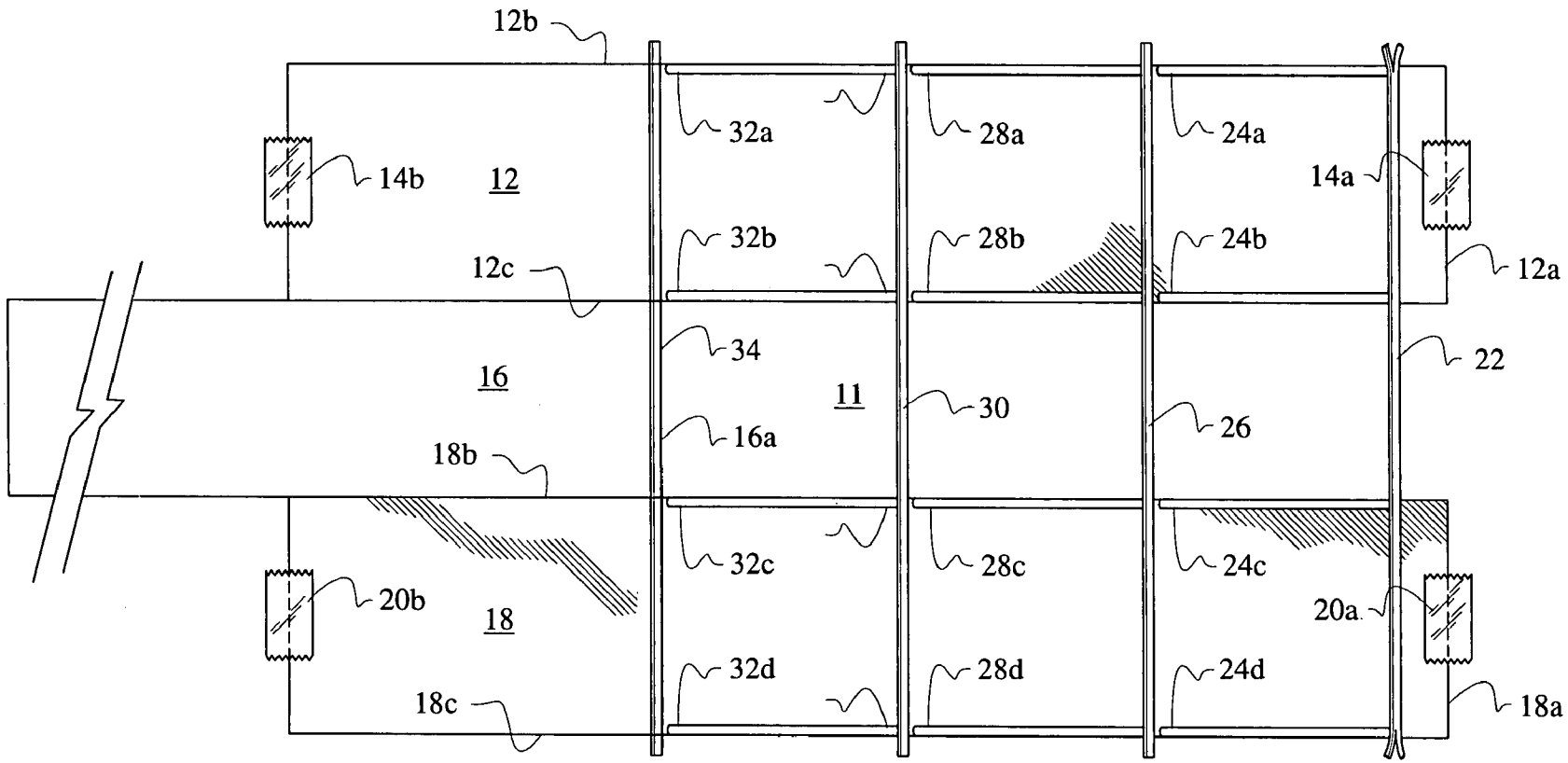
FIG. 13 is a top plan view like FIG. 12 but adding a fourth elongate bamboo strut.

Adhesive is then applied to a fourth elongate bamboo strut 34 and as depicted in FIG. 13, fourth elongate bamboo strut 34 is positioned in parallel relation to first, second, and third elongate bamboo struts 22, 26, and 30, respectively, in spaced relation to the free ends of truncate bamboo struts 32*a*–*d*. Specifically, fourth elongate bamboo strut 34 is spaced one-sixty-fourth of an inch (1/64") from said free ends. Note that said fourth elongate bamboo strut 34 is positioned coincident with right edge 16*a* of tissue separator template 16 to ensure that said fourth elongate bamboo strut 34 is squarely oriented with respect to first tissue strip 12 and second tissue strip 18.

Adhesive is then applied by brush to a fourth group of four truncate bamboo struts 36*a*, 36*b*, 36*c*, and 36*d*.

Figure 14:
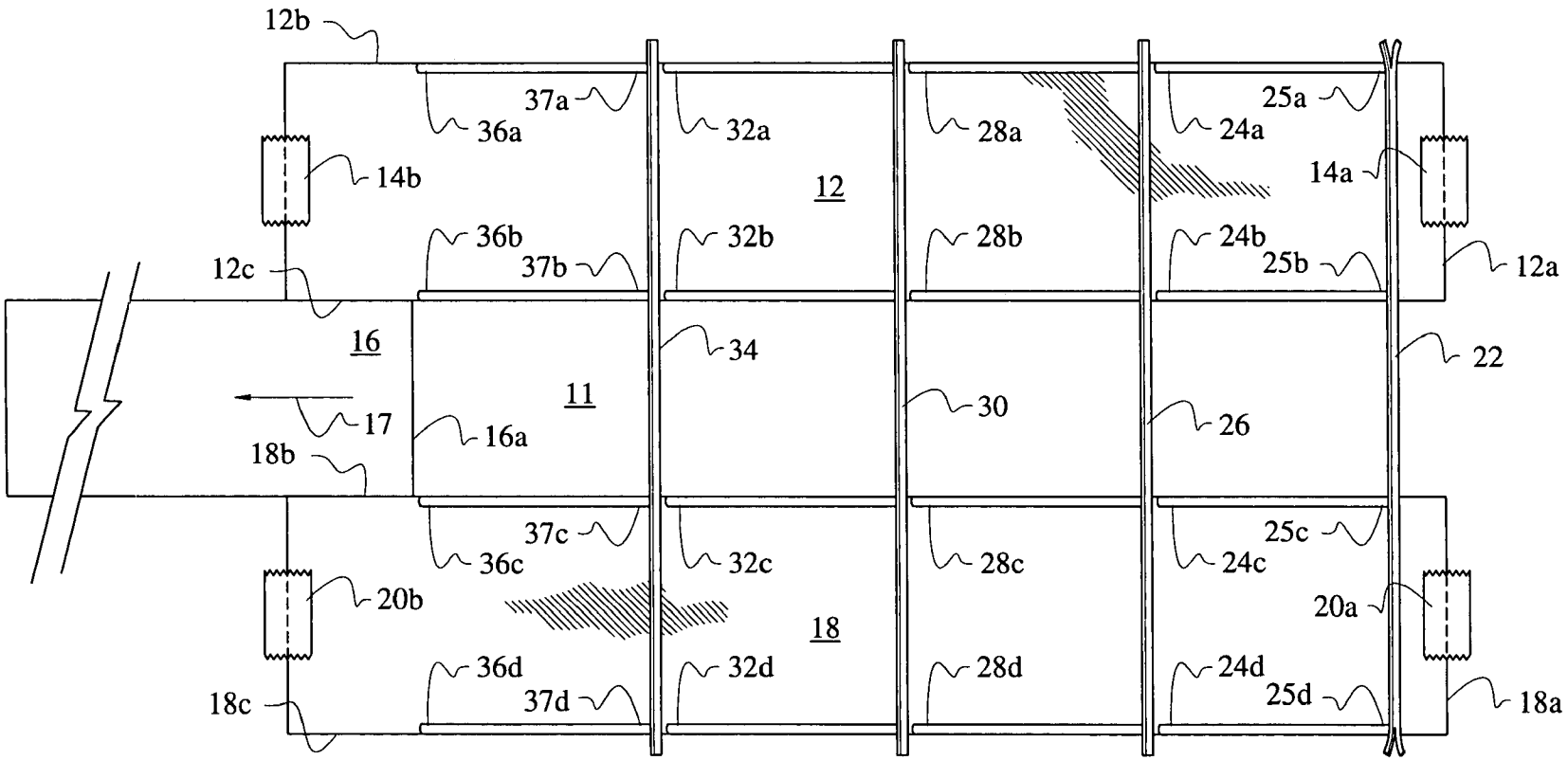
FIG. 14 is a top plan view like FIG. 13 but depicting a fourth displacement of the tissue separator template and adding a fourth plurality of truncate bamboo struts.

The fourth group of four truncate bamboo struts is positioned in the manner depicted in FIG. 14. Truncate bamboo struts 36*a*, 36*b* are deposited atop tissue strip 12 such that their respective trailing ends 37*a*, 37*b* are in abutting relation to fourth elongate bamboo strut 34 and so that said truncate bamboo struts 36*a*, 36*b* are disposed normal to said fourth elongate bamboo strut 34. Moreover, said truncate bamboo struts 36*a*, 36*b* are coincident with the longitudinal upper and lower edges 12*b*, 12*c*, respectively, of tissue strip 12.

Similarly, truncate bamboo struts 36*c*, 36*d* are deposited atop tissue strip 18 such that their respective trailing ends 37*c*, 37*d* are in abutting relation to fourth elongate bamboo strut 34 and so that truncate bamboo struts 37*c*, 37*d* are disposed normal to fourth elongate bamboo strut 34. Moreover, truncate bamboo struts 36*c*, 36*d* are coincident with the longitudinal upper and lower edges 18*b*, 18*c*, respectively, of tissue strip 18.

Tissue separator template 16 is now removed because it has fulfilled its purpose of maintaining tissue strips 12 and 18 in spaced, parallel relation to one another during the adhering of the elongate and truncate bamboo struts thereto in the manner just described in connection with FIGS. 8–14.

Figure 15A:
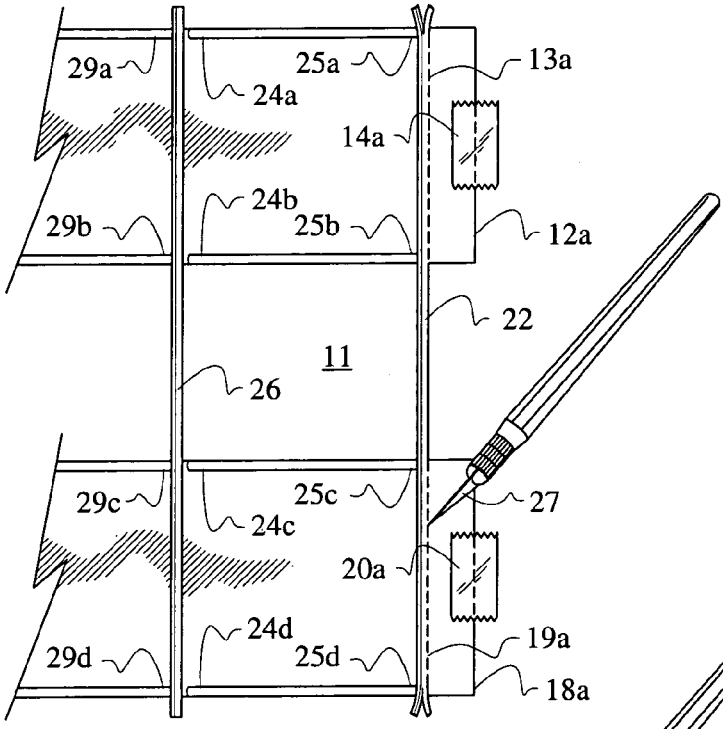
FIG. 15A is a top plan view depicting the trimming of excess tissue from the right end of the assembly of FIG. 14.

As depicted in FIG. 15A, sharp blade 26 is then used to trim that part of tissue strips 12 and 18 that extends to the right of first elongate bamboo strut 22. First elongate bamboo strut 22 may be used as a guide during such trimming. The cut line formed in tissue 12 is denoted 13*a* and the cut line formed in tissue 18 is denoted 19*a*.

Figure 15B:
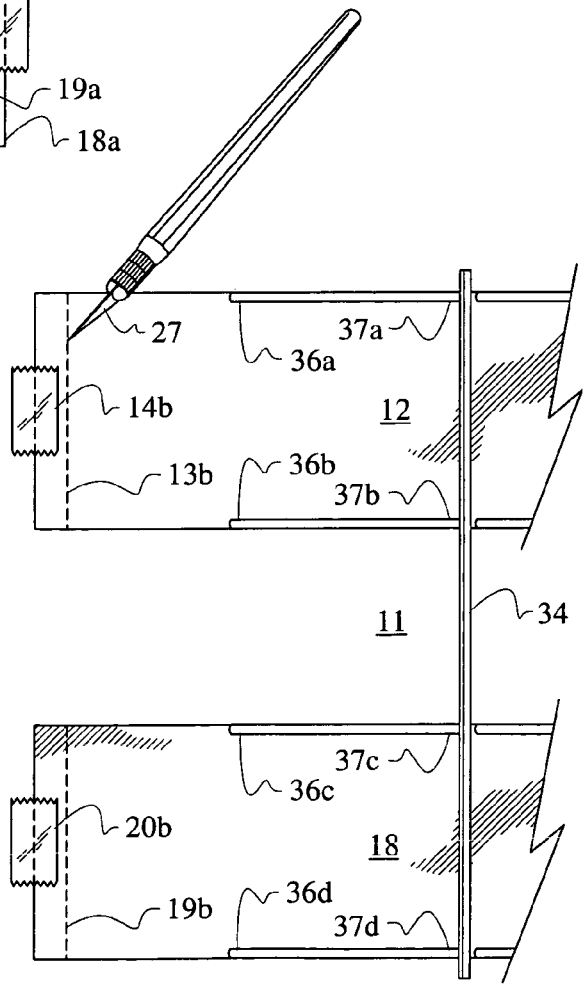
FIG. 15B is a top plan view depicting the trimming of excess tissue from the left end of the assembly of FIG. 14.

Then, as depicted in FIG. 15B, excess tissue is trimmed from the opposite edge of first and second tissue strips 12, 18 by the same tool. Specifically, the cuts are made just to the right of tape members 14*b* and 20*b*. The cut line formed in tissue 12 is denoted 13*b* and the cut line formed in tissue 18 is denoted 19*b*.

Figure 16:
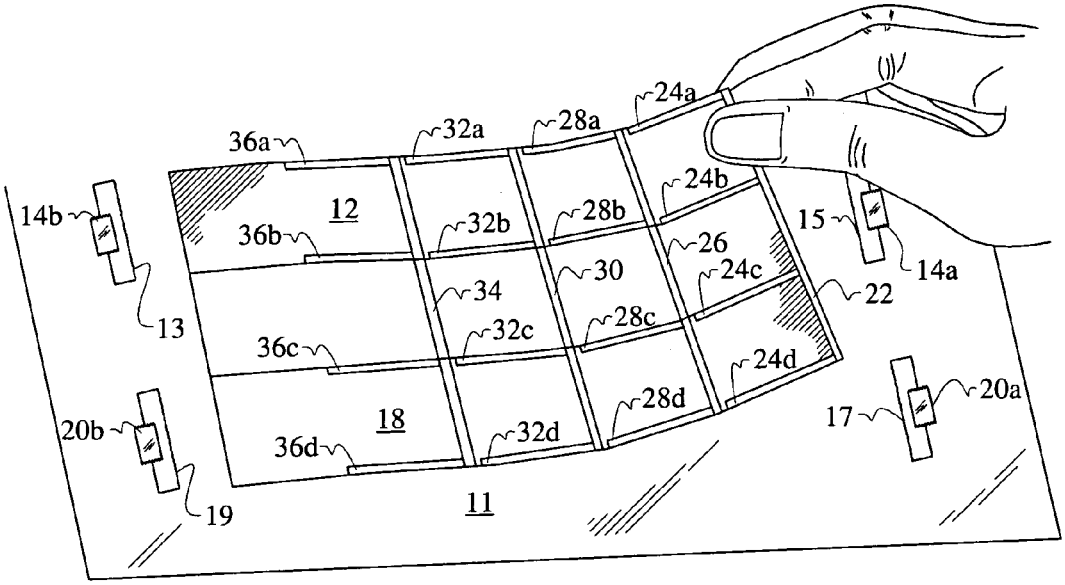
FIG. 16 is a perspective view depicting the lifting of the assembly of FIG. 14 from the support surface after the cuts of FIGS. 15A and 15B have been made.

The assembly is then carefully lifted from Plexiglas® table 11 as depicted in FIG. 16. Care must be taken in such lifting process because some glue may have adhered to the Plexiglas® and any such adhered points must be overcome without tearing tissue papers 12 or 18.

Figure 17:
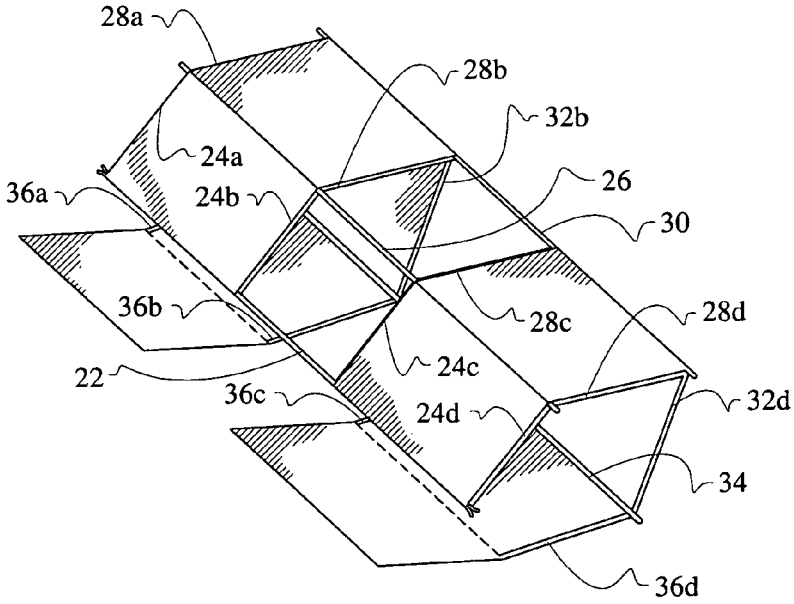
FIG. 17 is a perspective view depicting the folding of the assembly of FIG. 16 into a box configuration.

The assembly is then folded as depicted in FIG. 17. The object of the fold is to form a square parallelogram and it should be understood that FIG. 17 depicts an intermediate position of the novel parts as they are folded from their FIG. 16 configuration into the square parallelogram configuration.

Figure 18:
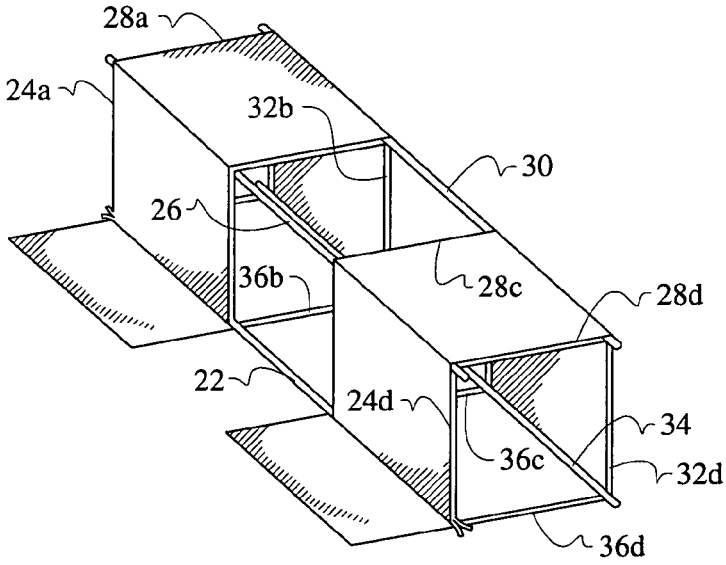
FIG. 18 is a perspective view depicting the completion of the folding procedure.

The square parallelogram is depicted in FIG. 18. Elongate bamboo strut 34 abuts the free ends of truncate bamboo struts 36*a*, 36*b*, 36*c*, 36*d* and the assembly forms a substantially perfect square when seen in end view.

Figure 19:
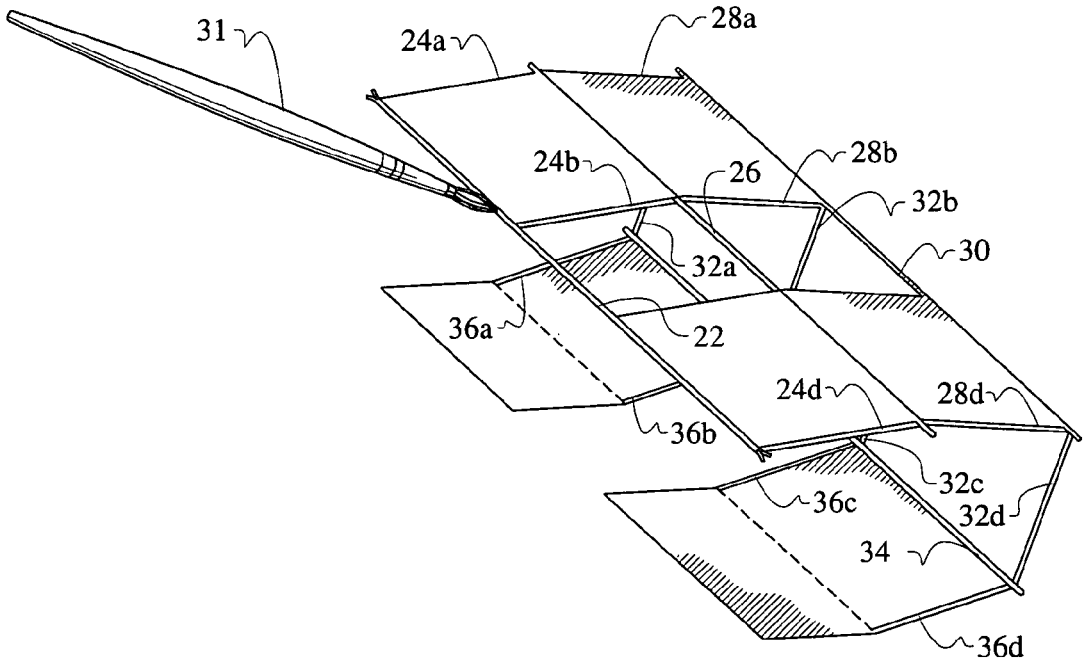
FIG. 19 is a perspective view depicting the partial unfolding of the assembly of FIG. 18 for the purpose of applying an adhesive to an elongate bamboo strut.

The assembly is then unfolded from its FIG. 18 position into its FIG. 19 position so that adhesive may be applied by brush 31 to elongate bamboo strut 22, along the surface thereof that abuts the tissue paper when the assembly is in its FIG. 18 position.

Figure 20:
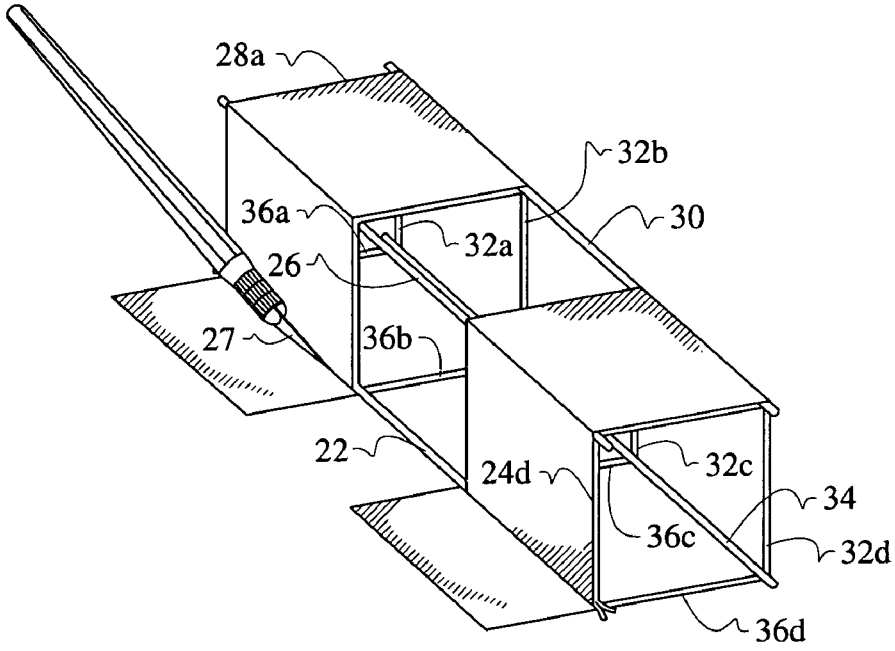
FIG. 20 is a perspective view depicting the trimming of excess tissue from the folded box kite.

The assembly is then returned to its FIG. 18 position before the adhesive cures. When the adhesive has cured, knife blade 26 is employed as depicted in FIG. 20 to trim away the tissue paper to the left of elongate bamboo strut 22.

Figure 21:
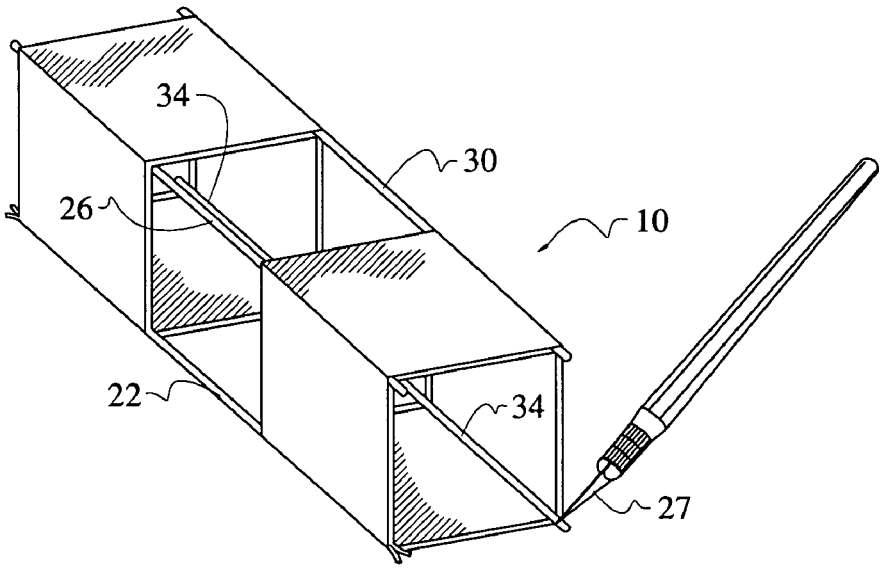
FIG. 21 is a perspective view depicting the trimming of excess bamboo from the bamboo struts.

As was noted in connection with FIGS. 8–14, about three-thirty-seconds of an inch (3/32") or so of elongate bamboo struts 22, 26, 30, and 34 extends beyond the upper and lower longitudinal edges of tissue strips 12 and 18, respectively, during the assembly process. In other words, the opposite ends of said elongate bamboo struts overhangs tissue paper 12, 18 by three-thirty-seconds of an inch (3/32"). This overhang is trimmed from struts 26, 30, and 34 by sharp knife blade 26, as depicted in FIG. 21, so that the respective opposite ends of each of said struts 26, 30, and 34 are even (flush) with tissue paper 12, 18 and the truncate bamboo struts. Each cut is performed with the strut to be cut disposed in abutting relation to the solid surface of table 11, i.e., the kite is rotated after each cut to bring the next strut into supported relation to the table. Note that the overhang of elongate bamboo strut 22 is not trimmed. The "V" cut formed in the opposite ends of strut 22 is preserved because said "V" cuts perform important functions in the completed box kite.

The completed box kite is now inspected to insure that all areas of tissue are correctly attached to all pieces of bamboo.

If any separation is found, adhesive is applied to the affected struts, whether elongate or truncate, and the tissue is adhered thereto and allowed to dry.

A toothpick is the preferred tool for applying glue spots to all locations where thread is to be adhered.

Figure 22:
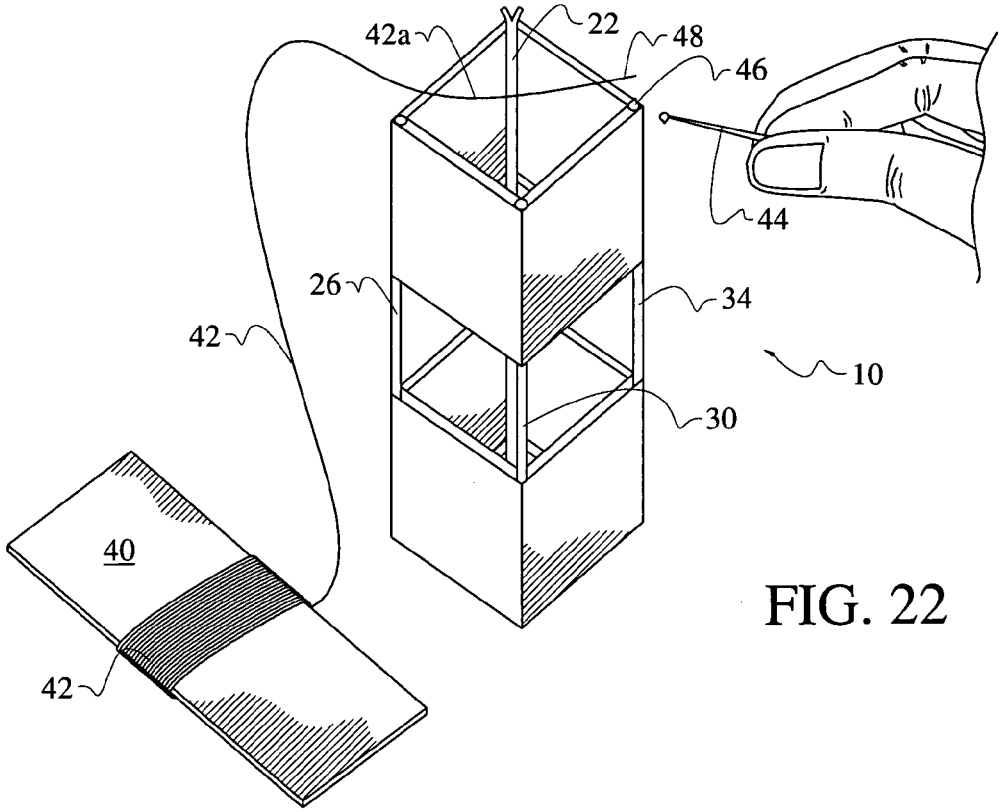
FIG. 22 is a perspective view depicting the first step of the adhering of a distal end of an elongate thread to the box kite.

Thread card 40 has an elongate length of thread 42 wound therearound as depicted in FIG. 22. Box kite 10 is placed on one of its ends in an upstanding configuration relative to tabletop 11 as depicted in FIG. 22. Toothpick 44 is used to apply glue spot 46 to the exposed end of elongate bamboo strut 34. A short length of thread 42 is unwound from thread card 40. The free end 48 of thread 42 is placed into contact with glue spot 46 and is held in said location when the adhesive cures. Note in FIG. 22 that a short extent 42*a* of thread 42 lies diagonally across the top of box kite 10 while glue spot 46 is drying.

It should also be understood that box kite 10 is not perfectly square at this point of the manufacturing process.

Figure 23:
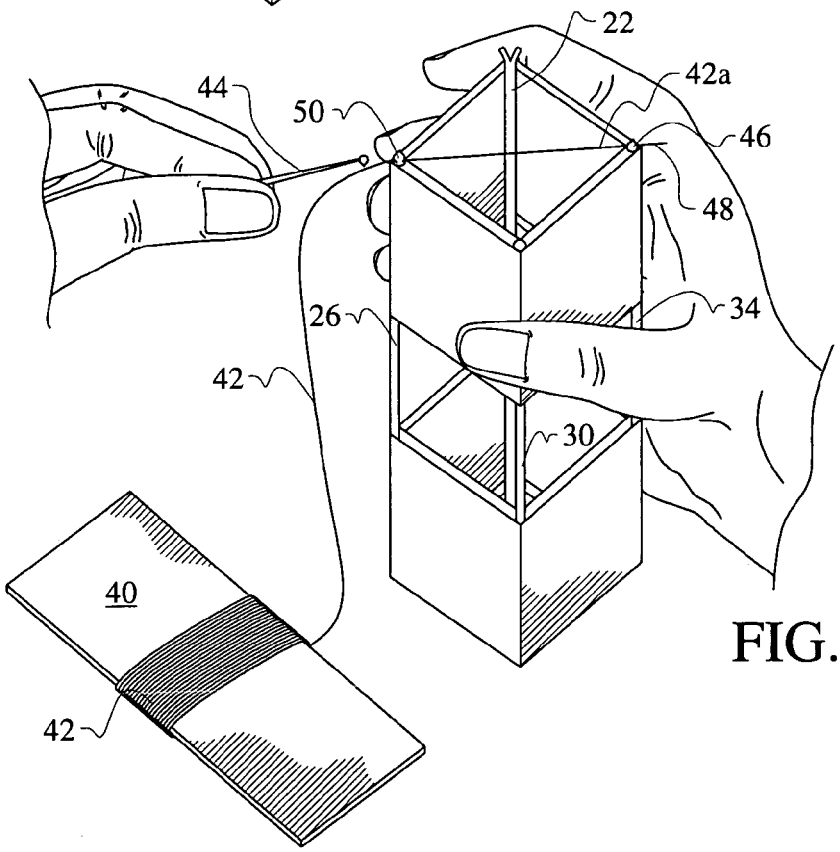
FIG. 23 is a perspective view like FIG. 22, depicting the second step of said adhering.

Box kite 10 is then gently lifted in one hand from table surface 11 as depicted in FIG. 23. Glue spot 50 is applied to the upper end of elongate bamboo strut 26 that is diagonally opposite to elongate bamboo strut 34. Box kite 10 is then gently squeezed between the thumb and forefinger until the elongate bamboo struts 22, 26, 30, and 34 and tissue paper 12, 18 between them appear to enter into a perfect square arrangement. A perfect square need not be formed, but the square should appear to be perfect to the eye. The free hand is then used to pull thread 42 taut diagonally across the top of box kite 10 as depicted in FIG. 23 so that the thread comes into contact with glue spot 50. Thus, when the glue dries, section 42*a* of thread 40 is taut and the end of box kite 10 to which thread 42*a* is attached forms a substantially square parallelogram.

Box kite 10 is then returned to tabletop 11 in its upright position until glue spots 46 and 50 are dry. Thread 42 between thread card 40 and box kite 10 may hang in a slack fashion as depicted in FIG. 23.

A pair of scissors, not shown, is then used to cut thread 42*a* about one-half inch (½") from glue spot 50 in the manner depicted in FIG. 24.

Box kite 10 is then inverted (see FIG. 25) and toothpick 44 is used to apply glue spot 52 at the exposed end of elongate bamboo strut 26. Another short length of thread 42 is unwound from thread card 40. The free end of thread 42 is placed into contact with glue spot 52 and is held in said location when the adhesive cures. Box kite 10 is then again gently lifted in one hand from the table surface (not expressly shown with the kite in its inverted configuration). Glue spot 54 is applied to the upper end of elongate bamboo strut 34 that is diagonally opposite to elongate bamboo strut 26. Box kite 10 is then gently squeezed between the thumb and forefinger until the elongate bamboo struts 22, 26, 30, and 34 and tissue paper 12, 18 between them appear to enter into a perfect square arrangement. A perfect square need not be formed, but the square should appear to be perfect to the eye. The free hand is then used to pull thread 42*b* taut diagonally across the top of the box kite so that the thread comes into contact with said glue spot 54. Thus, when the glue dries, section 42*b* of thread 40 is taut and the box kite forms a substantially square parallelogram.

A pair of scissors, not shown, is then used to cut thread 42*b* about one-half inch (½") from glue spot 54, as depicted in connection with thread 42*a* and glue spot 50 in FIG. 24.

FIG. 25 also depicts the attachment of adjustable thread line 43, i.e., the balance of the thread wrapped around thread card 40. The free end of thread 42, after the cutting of section 42*b* as aforesaid, is now denoted 58. The kite assembly is again gently squeezed until it has a square shape. Thread 42 is pressed into "V" slot 28*a* (or 28*b*, depending upon which end of kite 10 is in the "up" or exposed position). Toothpick 44 is used to apply glue spot 56 to the exposed end of elongate bamboo strut 30, and free end 58 of thread 42 thereof is brought into contact with glue spot 56.

Figure 26:
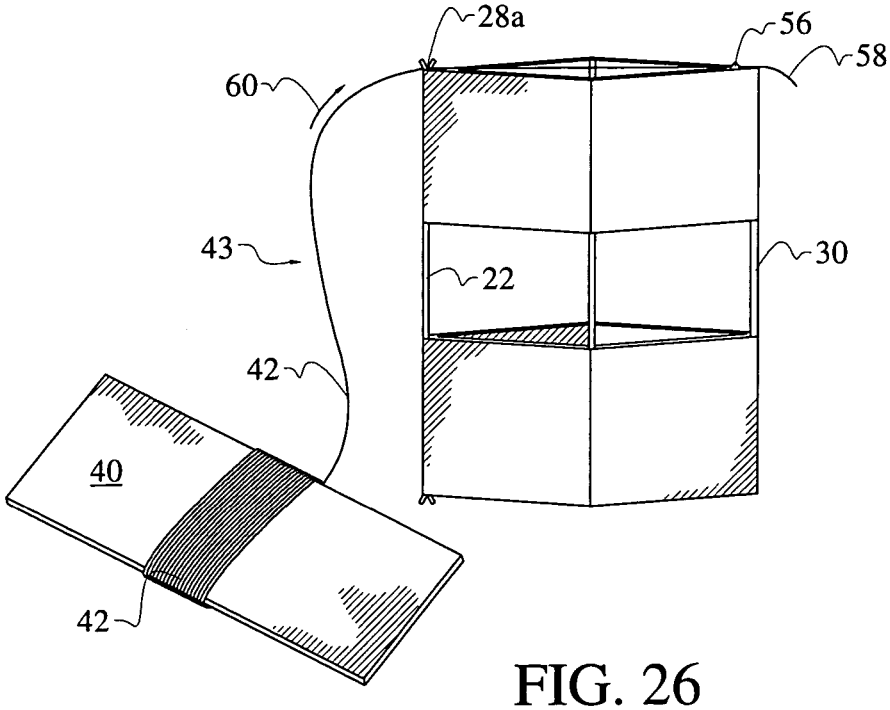
FIG. 26 is a perspective view depicting the box kite in a flattened configuration.

When glue spot 56 has dried, securing free end 58 to the end of elongate bamboo strut 30, the box kite is gently flattened as depicted in FIG. 26. This causes thread 42 to slide through "V" slot 28*a* as indicated by single-headed directional arrow 60.

Figure 27:
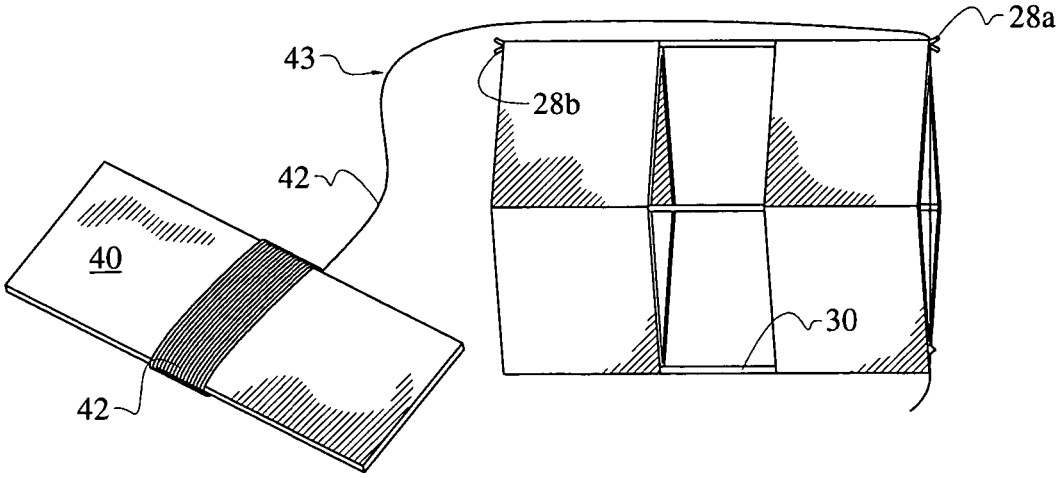
FIG. 27 is a perspective view depicting how the length of the adjustable thread line is determined.

The flattened box kite assembly is then placed on its side as depicted in FIG. 27, and thread 42 is inserted into "V"-shaped slot 28*a*, leaving about a quarter inch (¼") of slack in said thread between "V" slot 28*a* and "V"-shaped slot 28*b*.

Figure 28:
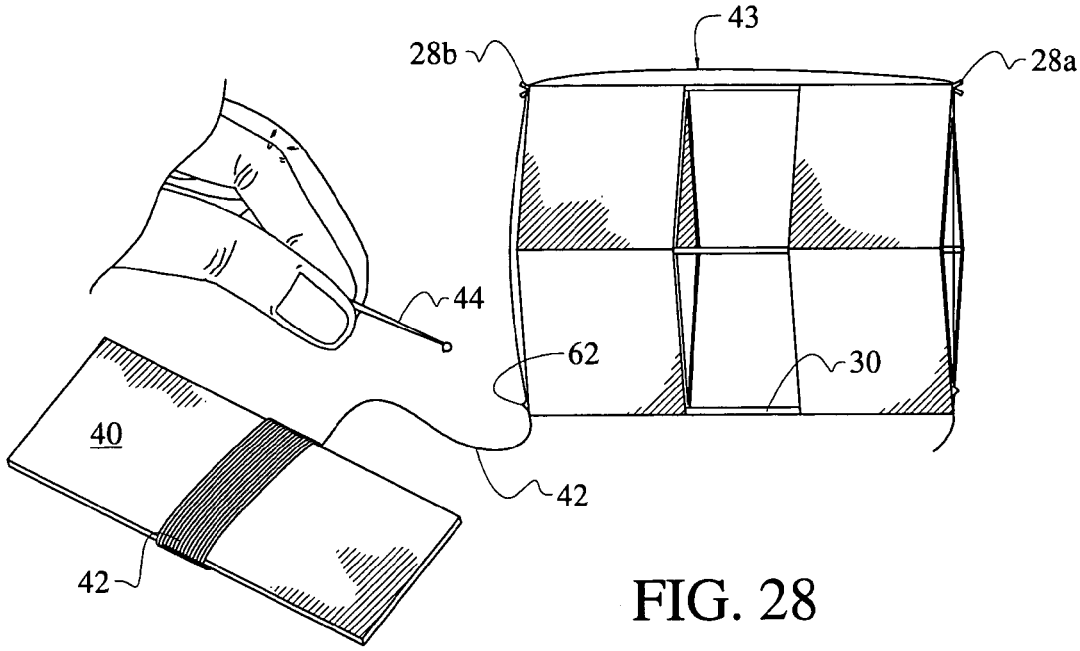
FIG. 28 is a perspective view depicting the adhering of the adjustable thread line to a corner of the box kite.

As depicted in FIG. 28, a glue spot 62 is then applied by toothpick 44 to the end of elongate bamboo strut 30 and thread 42 is pulled taut from "V"-shaped slot 28*b* to said glue spot and brought into contact therewith.

Figure 29:
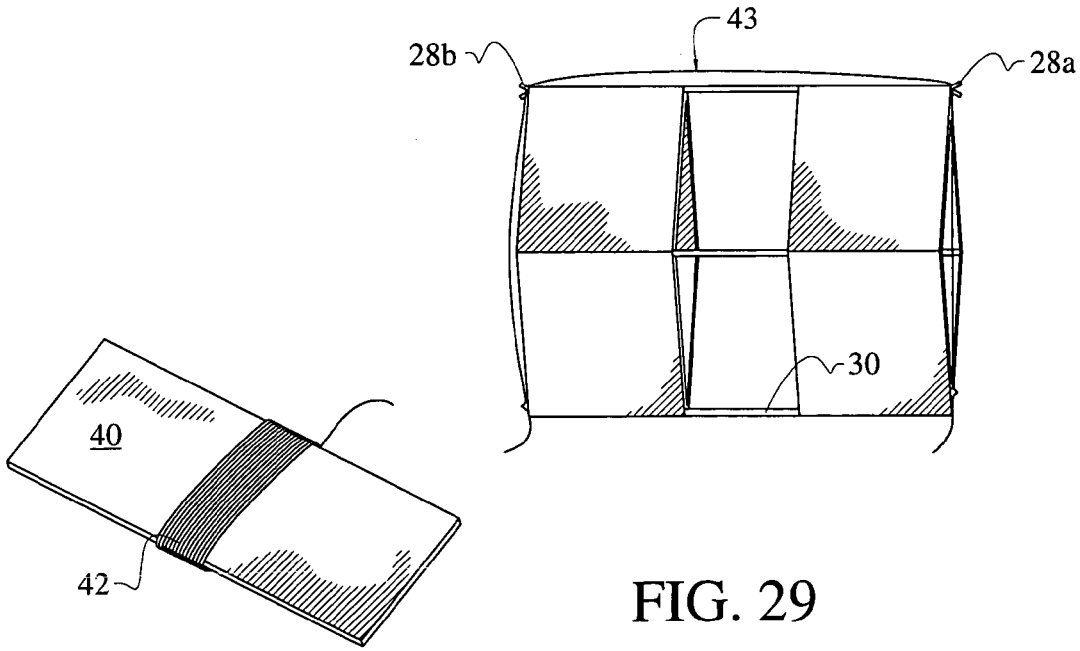
FIG. 29 is a perspective view depicting the cutting of the thread.

Thread 42 is then cut with a pair of scissors, not shown, about one-half inch (½") from said glue spot 62 as depicted in FIG. 29.

Pulling on that part of adjustable thread line 43 positioned between "V"-shaped slot 28*a* and "V"-shaped slot 28*b* (the part having about a quarter inch (¼") slack) opens the box kite from the flattened configuration of FIG. 29 into the square parallelogram configuration of FIG. 30.

Thread 42 is then positioned as deep within "V"-shaped slots 28*a*, 28*b* as possible (see FIG. 31A) and toothpick 44 is employed to add glue spots 64, 66 to ends 28*a* and 28*b* of elongate bamboo strut 22, respectively, as indicated in FIG. 31. By positioning thread 42 deep within each "V"-shaped slot, said thread is spaced apart from each glue spot 64, 66 and thus said thread is free to slide within said "V"-shaped slots after the glue has dried.

At this point of the novel method, an additional small spot of glue may be placed atop each glue spot on the top of said "V"-shaped slots and on top of all of the other glue spots as well to reinforce all glue spots.

Figure 32:
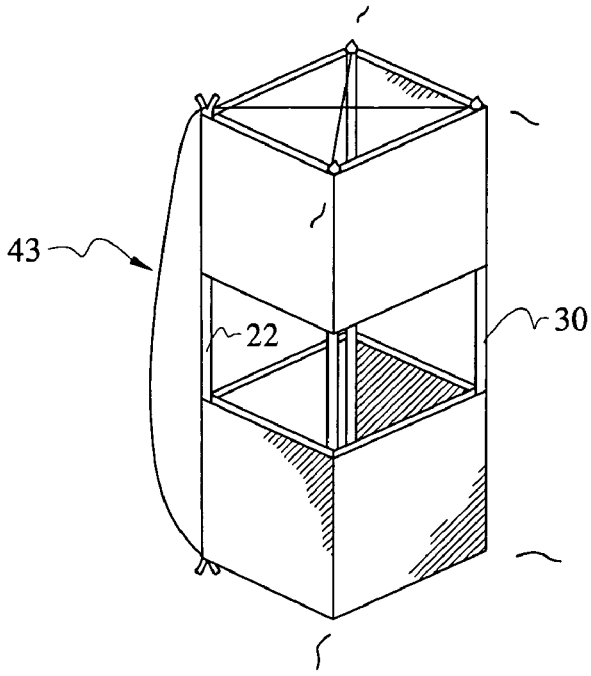
FIG. 32 is a perspective view depicting the trimming of excess threads.

When the glue has dried, all excess thread ends are cut off flush with the corners of the box kite by a pair of sharp scissors, not shown, as indicated in FIG. 32.

Figure 33B:
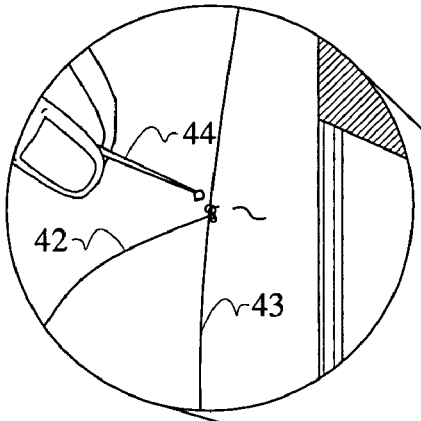
FIG. 33B is a detailed perspective view of the parts circled in FIG. 33A.
Figure 33A:
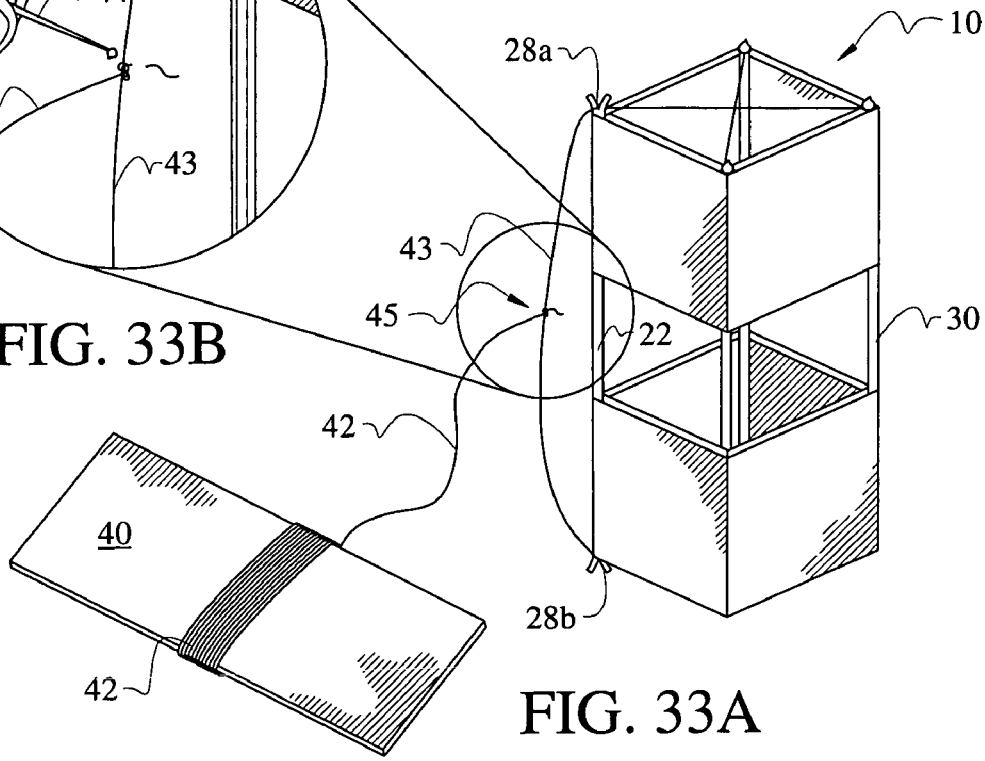
FIG. 33A is a perspective view depicting the tying of the main thread to the adjustable thread line.

The leading end of line 42 from thread card 40 is then tied, using a triple knot 45, to the middle of adjustable thread line 43 as indicated generally in FIG. 33A and in more detail in FIG. 33B. Excess thread is cut with a scissors at a distance about one eighth inch (⅛") from triple knot 45. Toothpick 44 is then employed to place a small spot of glue on the triple knot, but not on adjustable thread line 43.

Figure 34A:
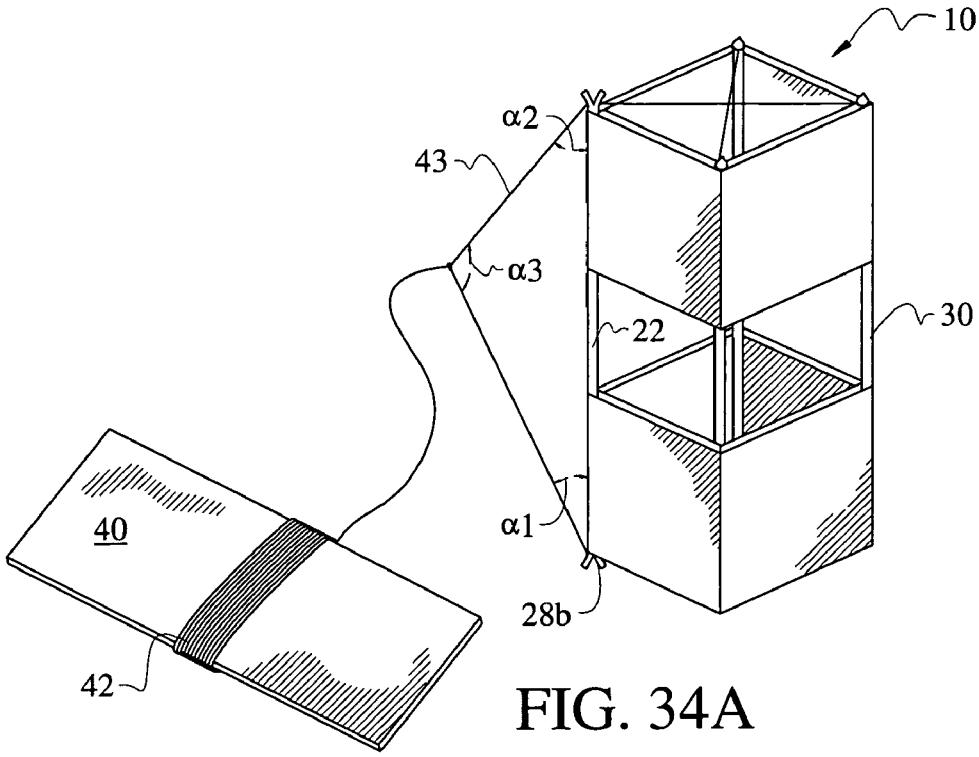
FIG. 34A is a perspective view of the adjustable thread line under tension.

When adjustable thread line 43 is pulled taut, as depicted in FIG. 34A, with box kite 10 fully open, a forty-sixty-five-seventy-five degree (40-65-75°) triangle is formed. More particularly, angle $\alpha 1$ is forty degrees (40°), $\alpha 2$ is sixty-five degrees (65°), and $\alpha 3$ is seventy-five degrees (75°).

Figure 34B:
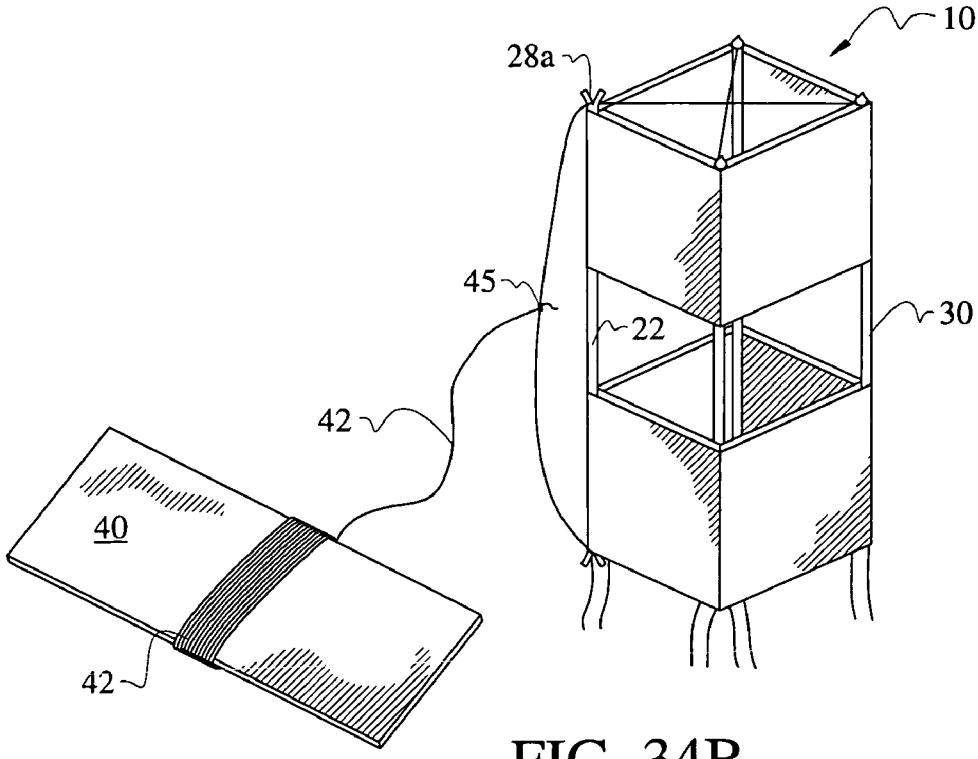
FIG. 34B is a perspective view of the adjustable thread line when in repose.

These angles may be achieved, as depicted in FIG. 34B, by allowing adjustable thread line 43 to be in repose and positioning triple knot 45 in registration with the center of kite 10, i.e., at the midpoint of bamboo strut 22.

The tails are then attached to the lower end of kite 10. Box kite 10 is first laid onto its side so it is not standing up.

Figure 35A:
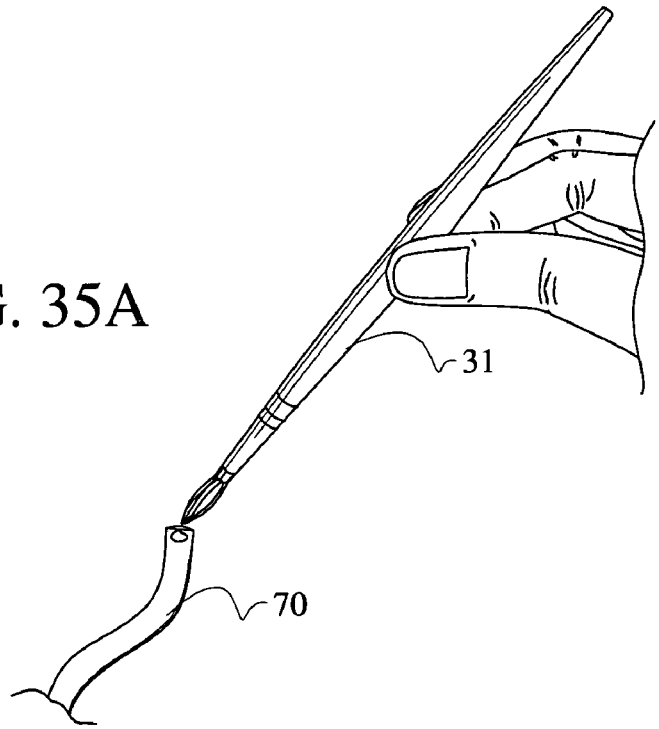
FIG. 35A is a perspective view depicting the application of a glue spot to a tail of the box kite.
Figure 35B:
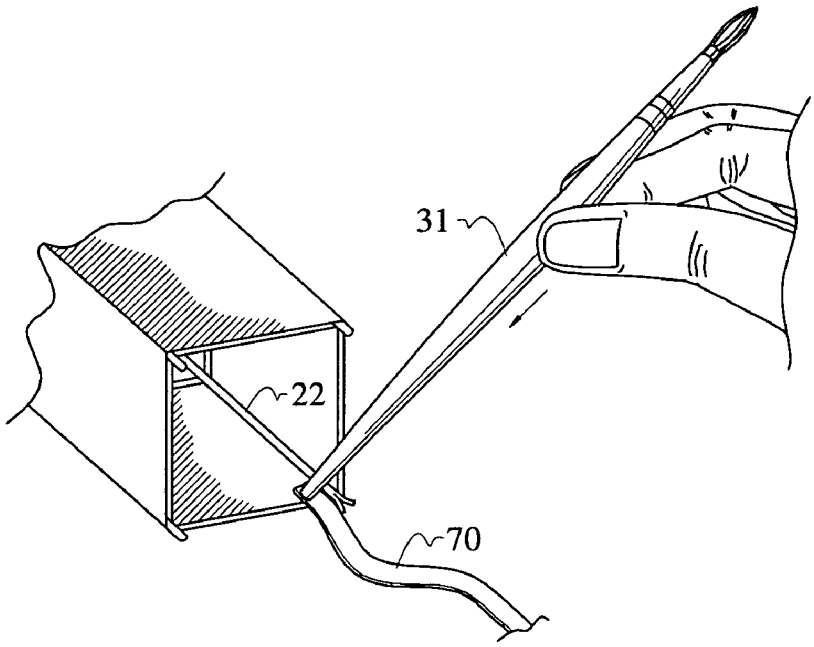
FIG. 35B is a perspective view depicting the application of a tail to the box kite.

As indicated in FIG. 35A, glue is applied with a brush to the leading one-eighth inch (⅛") of a tail. The rigid end of the brush handle is used as depicted in FIG. 35B to press the glued extent of said tail into position on the kite.

Figure 35C:
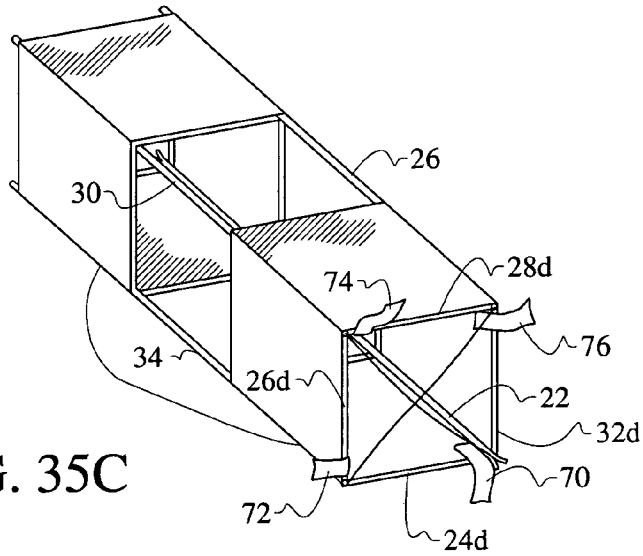
FIG. 35C is a perspective view of the bottom of the box kite depicting the positioning of all four tails.

In this preferred embodiment, four (4) tails are attached to box kite 10 in the positions depicted in FIG. 35C. Thus, there is one tail mounted on each of the bamboo struts that define the bottom of kite 10 and each tail is adjacent a corner of the box kite that is reserved for said tail, i.e., no two tails are positioned adjacent the same corner.

Before attaching the tails, a final inspection of the novel box kite is made to insure that all pieces of bamboo are properly glued to tissue and to check the adjustable thread lines to make sure they work well in the "V"-shaped slots for easy folding and setting in the open box locked position.

The method for actual gluing of the four (4) tails is depicted in FIGS. 36A–D. The tails are glued one at a time.

Figure 36A:
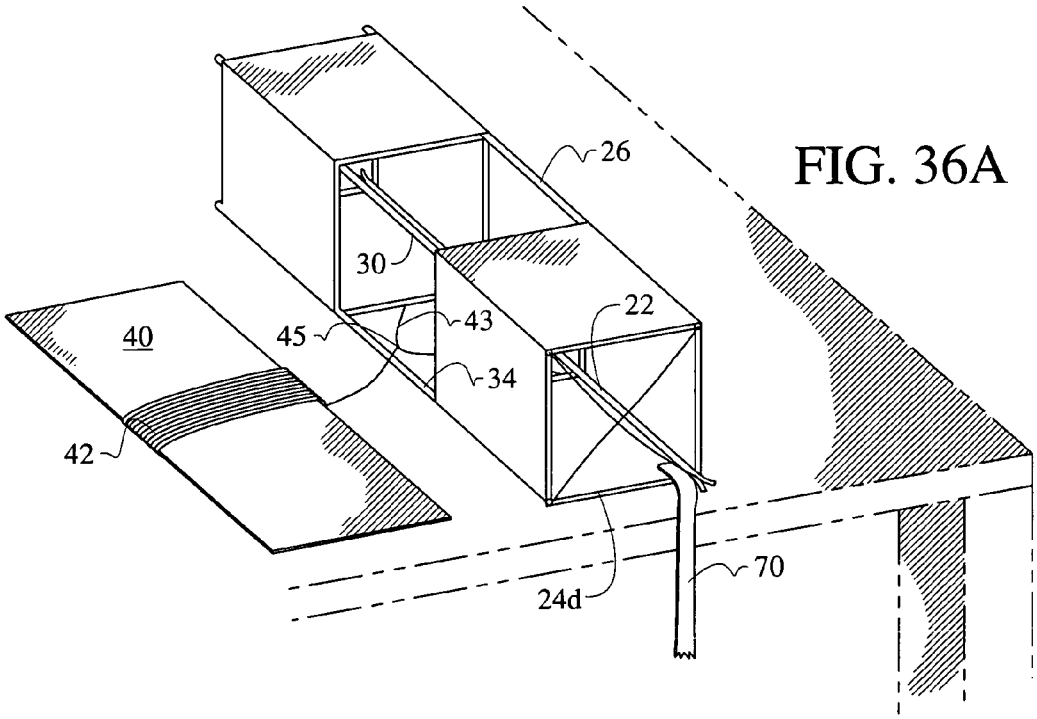
FIG. 36A is a perspective view depicting the attachment of a first tail to the box kite.

In FIG. 36A, box kite 10 is positioned so that triple knot 45 of thread card line 42 (FIG. 33A) is positioned in underlying relation to said box kite. This positions bamboo struts 22 and 34 and hence bamboo strut 24*d* into overlying relation to table top 11. First tail 70 is inserted into position as shown, with one-quarter inch (¼") of said tail extending into the hollow interior of the kite. The gluing is accomplished as discussed above in connection with FIGS. 35A and 35B. The free end of the tail is allowed to hang over the edge of tabletop 11.

Figure 36B:
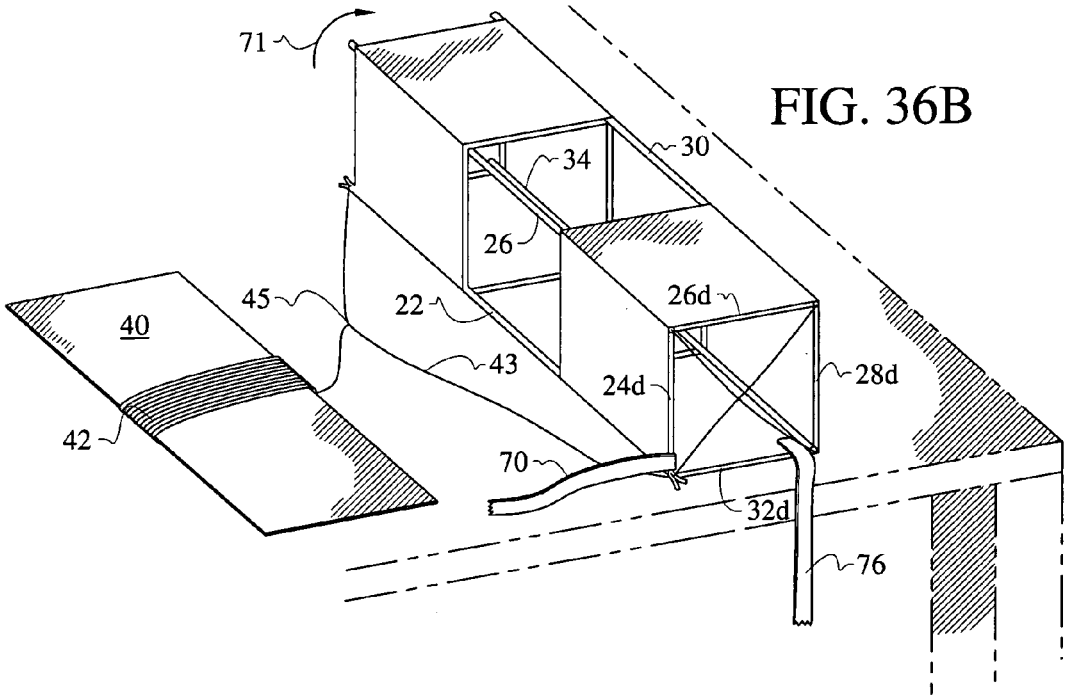
FIG. 36B s a perspective view depicting the attachment of a second tail to the box kite.

After the glue on tail 70 has dried, the box kite is rotated ninety degrees (90°) as denoted by directional arrow 71 in FIG. 36B until bamboo struts 22, 26 are disposed into overlying relation to table top 11. This positions triple knot 45 in laterally spaced relation to box kite 10. The gluing procedure described above is repeated with tail 72 and the free end of said tail is allowed to hang over the edge of tabletop 11 as depicted.

Figure 36C:
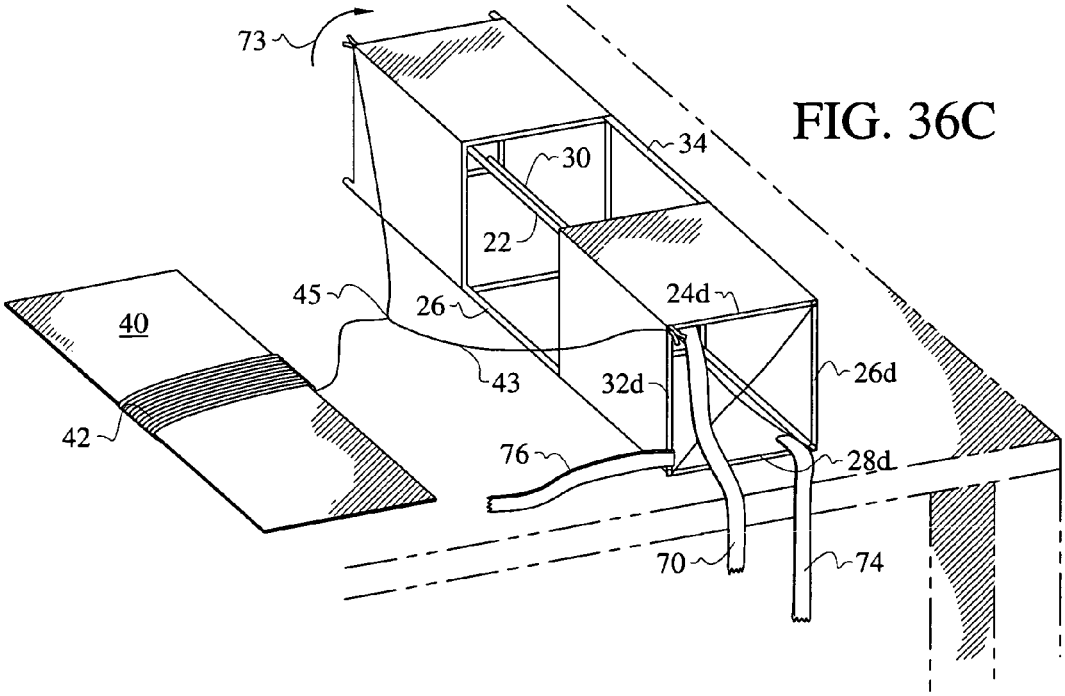
FIG. 36C is a perspective view depicting the attachment of a third tail to the box kite.

After the glue on tail 72 has dried, box kite 10 is rotated ninety degrees (90°) as denoted by directional arrow 73 in FIG. 36C until bamboo struts 26, 30 are disposed into overlying relation to tabletop 11. This positions the opposite ends of adjustable thread 43 in vertically spaced relation to tabletop 11. The gluing procedure described above is repeated with tail 74 and the free end of said tail is allowed to hang over the edge of tabletop 11 as depicted.

Figure 36D:
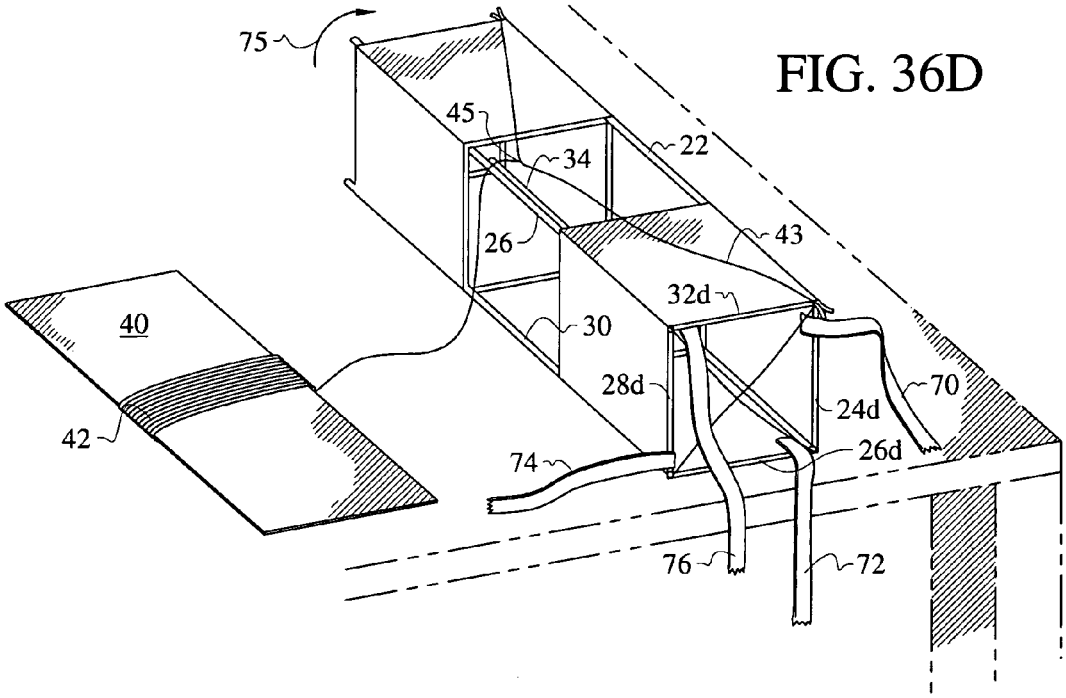
FIG. 36D is a perspective view depicting the attachment of a fourth tail to the box kite.

After the glue on tail 74 has dried, the box kite is rotated ninety degrees (90°) as denoted by directional arrow 75 in FIG. 36D until bamboo struts 30, 34 are disposed into overlying relation to table top 11. This positions triple knot 45 in vertically spaced relation to table top 11. The gluing procedure described above is repeated with tail 76 and the free end of said tail is allowed to hang over the edge of tabletop 11 as depicted.

Since box kite 10 is rotated three (3) times during the tail-attachment process, it is important to have sufficient thread unrolled from thread card 40 to enable such rotation to be made. However, by beginning in the position depicted in FIG. 36A, and not the position of 36D, the amount of thread that must be unrolled from thread card 40 is minimized.

Box kite 10 is then stood on its end as depicted in FIG. 37*a*, in its fully open position. Glue is applied, using brush 31, to each corner of the assembly. More particularly, there are sixteen (16) corners in box kite 10 where tissue meets bamboo and two (2) drops of glue 31*a*, 31*b* are applied to each of said corners as depicted in FIG. 37B. Thus, thirty-two (32) drops of glue are applied. This gives strength to the tissue and prevents tearing of the tissue at its fold lines. Care must be taken to avoid application of the glue to "V"-shaped slots 28*a*, 28*b* or the thread lines.

Figure 39:
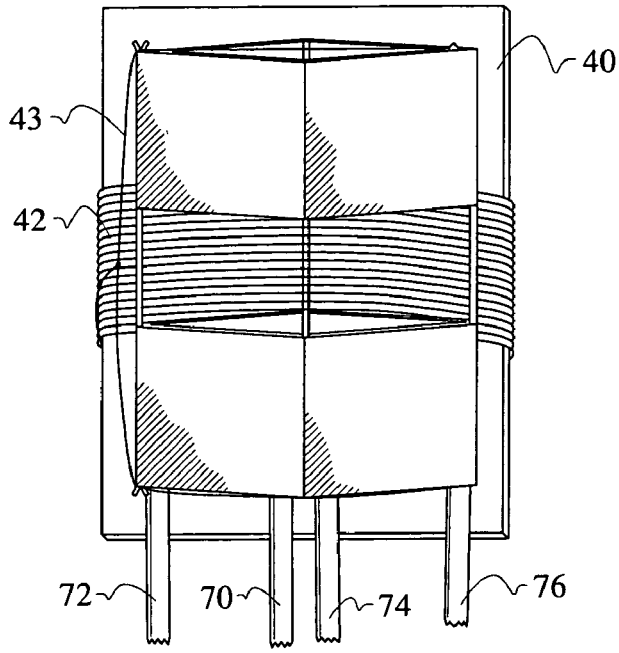
FIG. 39 is a perspective view depicting the flattened kite of FIG. 38 placed into overlying relation to the thread card.
Figure 40:
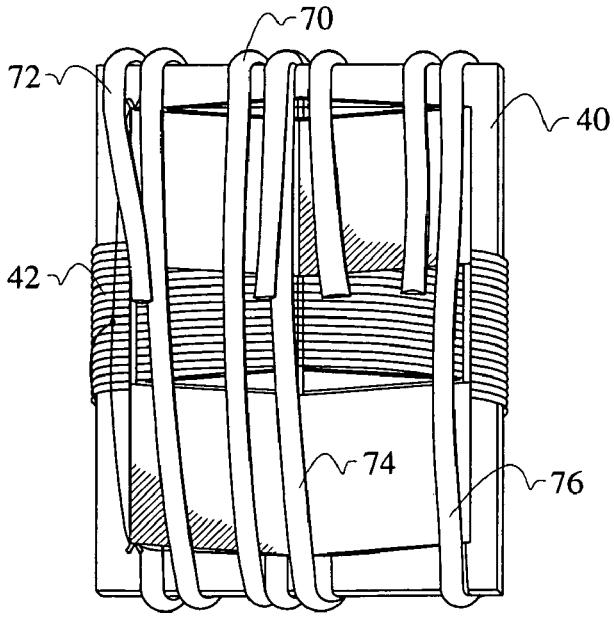
FIG. 40 is a perspective view depicting the wrapping of the tails about the flattened kite and the thread card preparatory to packaging the completed box kite.

The box kite is now ready to be packaged. Box kite 10 is flattened by loosening adjustable thread line 43 in "V"-shaped slots 28*a*, 28*b* and by pressing opposed corners toward one another between the forefinger and thumb. This flattening action brings tails 70, 72, 74, and 76 into linear alignment with one another as depicted in FIG. 38. Excess thread 42 is wrapped around thread card 40 as depicted in said FIG. 38 and box kite 10 is then placed atop said thread card 40 as depicted in FIG. 39. The tails are then wrapped about the thread card in the manner depicted in FIG. 40. The card is then placed into a package and the package is placed onto a display card.

The finished box kite is very light in weight and flies in a very light wind. Its miniature size adds to its attractiveness and encourages its use indoors with a large electric fan. However, it also works well out of doors, just like a full sized box kite.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A method for making a miniature box kite, comprising the steps of:

positioning a first strip of tissue paper into overlying relationship to a flat support surface;

positioning a tissue separator template into abutting relation to a preselected longitudinal edge of said first strip of tissue paper and aligning a first edge of said tissue separator template with a first edge of said first strip of tissue paper;

positioning a second strip of tissue paper having the same dimensions as first strip of tissue paper against a bottom longitudinal edge of said tissue separator template and aligning a first edge of said second strip of tissue paper with the first edge of said tissue separator template;

securing respective opposite ends of said first strip of tissue paper and said second strip of tissue paper to said flat support surface so that said tissue separator template is free to slide between them;

providing first, second, third and fourth elongate bamboo struts;

forming a "V"-shaped notch in opposite ends of said first elongate bamboo strut;

sliding said tissue separator template a first time in a longitudinal direction away from said respective first edges of said first and second strips of tissue paper until said first edge of said tissue separator template is in a first position that is misaligned with said respective first edges of said first and second strips of tissue paper;

securing said first elongate bamboo strut into overlying relation to said first and second strips of tissue paper in parallel and spaced apart relation to said respective first edges and in overlying relation to said first edge of said tissue separator template;

providing four sets of truncate bamboo struts where each set includes a first, second, third, and fourth truncate bamboo strut;

securing said first and second truncate bamboo struts of said first set of truncate bamboo struts to top and bottom longitudinal edges of said first strip of tissue paper so that respective trailing ends of said first and second bamboo struts are in abutting relation to said first elongate bamboo strut and so that said first and second truncate bamboo struts are disposed normal to said first elongate bamboo strut;

securing said third and fourth truncate bamboo struts of said first set of truncate bamboo struts to top and bottom longitudinal edges of said second strip of tissue paper so that respective trailing ends of said third and fourth truncate bamboo struts are in abutting relation to said first elongate bamboo strut and so that said third and fourth truncate bamboo struts are disposed normal to said first elongate bamboo strut;

sliding said tissue separator template a second time in a longitudinal direction away from said first elongate bamboo strut until said first edge of said tissue separator template is in a second position that is misaligned with said first elongate bamboo strut;

securing said second elongate bamboo strut into overlying relation to said first and second strips of tissue paper in parallel and spaced apart relation to said first elongate bamboo strut and in overlying relation to said first edge of said tissue separator template;

securing said first and second truncate bamboo struts of said second set of truncate bamboo struts to top and bottom longitudinal edges of said first strip of tissue paper so that respective trailing ends of said first and second bamboo struts of said second set of bamboo struts are in abutting relation to said second elongate bamboo strut and so that said first and second truncate bamboo struts of said second set of bamboo struts are disposed normal to said second elongate bamboo strut;

securing said third and fourth truncate bamboo struts of said second set of truncate bamboo struts to top and bottom longitudinal edges of said second strip of tissue paper so that respective trailing ends of said third and fourth truncate bamboo struts of said second set of bamboo struts are in abutting relation to said second elongate bamboo strut and so that said third and fourth truncate bamboo struts of said second set of bamboo struts are disposed normal to said second elongate bamboo strut;

sliding said tissue separator template a third time in a longitudinal direction away from said second elongate bamboo strut until said first edge of said tissue separator template is in a third position spaced justly slightly beyond respective leadings ends of said first, second, third, and fourth bamboo struts of said second set of truncate bamboo struts;

securing said third elongate bamboo strut into overlying relation to said first and second strips of tissue paper in parallel and spaced apart relation to said second elongate bamboo strut and in overlying relation to said first edge of said tissue separator template;

securing said first and second truncate bamboo struts of said third set of truncate bamboo struts to top and bottom longitudinal edges of said first strip of tissue paper so that respective trailing ends of said first and second bamboo struts of said third set of truncate bamboo struts are in abutting relation to said third elongate bamboo strut and so that said first and second truncate bamboo struts of said third sets of truncate bamboo struts are disposed normal to said third elongate bamboo strut;

securing said third and fourth truncate bamboo struts of said third set of truncate bamboo struts to top and bottom longitudinal edges of said second strip of tissue paper so that respective trailing ends of said third and fourth truncate bamboo struts of said third set of truncate bamboo struts are in abutting relation to said third elongate bamboo strut and so that said third and fourth truncate bamboo struts of said third set of truncate bamboo struts are disposed normal to said third elongate bamboo strut;

sliding said tissue separator template a fourth time in a longitudinal direction away from said third elongate bamboo strut until said first edge of said tissue separator template is in a fourth position spaced justly slightly beyond respective leadings ends of said first, second, third, and fourth truncate bamboo struts of said third set of truncate bamboo struts;

securing said fourth elongate bamboo strut into overlying relation to said first and second strips of tissue paper in parallel and spaced apart relation to said third elongate bamboo strut and in overlying relation to said first edge of said tissue separator template;

securing said first and second truncate bamboo struts of said fourth set of truncate bamboo struts to top and bottom longitudinal edges of said first strip of tissue paper so that respective trailing ends of said first and second bamboo struts of said fourth set of truncate bamboo struts are in abutting relation to said fourth elongate bamboo strut and so that said first and second truncate bamboo struts of said fourth set of truncate bamboo struts are disposed normal to said fourth elongate bamboo strut;

securing said third and fourth truncate bamboo struts of said fourth set of truncate bamboo struts to top and bottom longitudinal edges of said second strip of tissue paper so that respective trailing ends of said third and fourth truncate bamboo struts of said fourth set of truncate bamboo struts are in abutting relation to said fourth elongate bamboo strut and so that said third and fourth truncate bamboo struts of said fourth set of truncate bamboo struts are disposed normal to said fourth elongate bamboo strut;

removing said tissue separator template from its position between said first and second strips of tissue paper;

forming a box kite by folding said first and second strips of tissue paper into a square parallelogram configuration and securing said first and second strips of tissue paper so that they do not unfold; and securing a thread to said box kite;

whereby a miniature, operable box kite is assembled.

2. The method of claim 1, further comprising the step of:

separating said first and second strips of tissue paper from said support surface prior to the step of forming said box kite by folding said first and second strips of tissue paper into a square parallelogram configuration.

3. The method of claim 2, further comprising the step of:

trimming that part of said first and second strips of tissue paper that extends beyond said first elongate bamboo strut when said first and second strips of tissue paper are folded into said square parallelogram configuration.

4. The method of claim 1, further comprising the steps of:

dimensioning said first, second, third and fourth elongate bamboo struts to have a predetermined common length;

said predetermined common length being such that a top and a bottom end of said first, second, third and fourth elongate bamboo struts extend slightly beyond the top and bottom longitudinal edges, respectively, of said first and second strips of tissue when said first, second, third and fourth elongate bamboo struts are secured into overlying relation thereto.

5. The method of claim 4, further comprising the step of:

trimming the respective top and bottom ends of said second, third, and fourth elongate bamboo struts so that said second, third, and fourth elongate bamboo struts are flush with the top and bottom edges, respectively, of said first and second strips of tissue paper;

whereby the top and bottom ends of said first elongate bamboo strut extends slightly beyond said first and second longitudinal edges of said first and second strips of tissue paper.

6. The method of claim 1, further comprising the step of:

providing a flat thread card having a generally rectangular configuration;

wrapping an elongate length of thread around said flat thread card in transverse relation to a longitudinal extent thereof;

securing a free end of said thread to a top end of said fourth elongate bamboo strut;

extending said thread diagonally across a top end of said box kite, pulling said thread to make it taut, and securing said thread to a top end of said second elongate bamboo strut;

cutting said thread at a preselected point between said flat thread card and said second elongate bamboo strut;

inverting said box kite;

securing a leading end of said thread from said flat thread card to a bottom end of said second elongate bamboo strut;

extending said thread diagonally so that said thread extends to the bottom end of said fourth elongate bamboo strut;

pulling said diagonally disposed thread to make it taut and securing said diagonally disposed thread to said bottom end of said fourth elongate bamboo strut; and cutting said thread at a preselected point between said flat thread card and said fourth elongate bamboo strut.

7. The method of claim 6, further comprising the steps of:

attaching an adjustable thread line to said box kite by securing the leading end of said cut thread line to a bottom end of said third elongate bamboo strut;

extending said adjustable thread line diagonally so that said thread extends to the bottom end of said first elongate bamboo strut;

pulling said diagonally disposed thread to make it taut and positioning said diagonally disposed thread in said "V"-shaped slot formed in the bottom end of said first elongate bamboo strut; and flattening the box kite by squeezing it at said second and fourth elongate bamboo struts, said flattening causing said first and third elongate bamboo struts to move away from one another and causing said thread positioned in said "V"-shaped slot to slide therewithin.

8. The method of claim 7, further comprising the steps of:

positioning said flattened box kite on its side;

extending said adjustable thread line from said "V"-shaped slot formed in said bottom end of said first elongate bamboo strut to the "V"-shaped slot formed in said top end of said first elongate bamboo strut, leaving a predetermined amount of slack in said adjustable thread line;

extending said adjustable thread line from said "V"-shaped slot formed in said top end of said first elongate bamboo strut to a top end of said third elongate bamboo strut, pulling said adjustable thread line taut, and securing said adjustable thread line to said top end of said third elongate bamboo strut; and cutting said adjustable thread line at a preselected point between said top end of said third elongate bamboo strut and said flat thread card.

9. The method of claim 8, further comprising the steps of:

opening said flattened box kite into a square parallelogram configuration by pulling on said adjustable thread line between said "V"-shaped slot formed in said top end of said first elongate bamboo strut and said "V"-shaped slot formed in said bottom end of said first elongate bamboo strut; and positioning said box kite in upstanding relation to said support surface.

10. The method of claim 9, further comprising the steps of:

positioning said adjustable thread line deep within said "V"-shaped slot formed in said top end of said first elongate bamboo strut and said "V"-shaped slot formed in said bottom end of said first elongate bamboo strut; and depositing a drop of glue atop each of said "V"-shaped slots to prevent said adjustable thread line from exiting said "V"-shaped slots while allowing said adjustable thread line to slide relative to said "V"-shaped slots.

11. The method of claim 10, further comprising the step of:

securing a leading end of said thread line to said adjustable thread line.

12. The method of claim 11, further comprising the steps of:

prior to securing said leading end of said thread line to said adjustable thread line, pulling said adjustable thread line until it is taut and so that it forms a triangle where the angles thereof are forty, sixty-five and seventy-five degrees, said forty degree angle being formed where said adjustable thread line meets said top end of said first elongate bamboo strut, said sixty-five degree angle being formed where said adjustable thread line meets said bottom end of said first elongate bamboo strut, and said seventy-five degree angle being formed where said leading end of said thread line is secured to said adjustable thread line.

13. The method of claim 12, further comprising the step of attaching a plurality of tails to said box kite.

14. The method of claim 13, further comprising the steps of:

positioning said box kite onto its side;

positioning said first and fourth elongate bamboo struts into overlying relation with said support surface; and securing a leading end of a first tail to said trailing end of said fourth truncate bamboo strut of said first set of truncate bamboo struts.

15. The method of claim 14, further comprising the steps of:

rotating said box kite until said first and second elongate bamboo struts are positioned into overlying relation with said support surface; and securing a leading end of a second tail to said trailing end of said fourth truncate bamboo strut of said second set of truncate bamboo struts.

16. The method of claim 15, further comprising the steps of:

rotating said box kite until said second and third elongate bamboo struts are positioned into overlying relation with said support surface; and securing a leading end of a third tail to said trailing end of said fourth truncate bamboo strut of said third set of truncate bamboo struts.

17. The method of claim 16, further comprising the steps of:

rotating said box kite until said third and fourth elongate bamboo struts are positioned into overlying relation with said support surface; and securing a leading end of a fourth tail to said trailing end of said fourth truncate bamboo strut of said fourth set of truncate bamboo struts.

18. The method of claim 17, further comprising:

positioning said box kite in its upstanding configuration;

applying at least one drop of adhesive to each corner of said box kite where tissue and bamboo meet, there being sixteen of said corners, eight of which include said first strip of tissue and eight of which include said second strip of tissue.

19. The method of claim 18, further comprising:

loosening said adjustable thread line and flattening said box kite;

wrapping said thread around said flat thread card;

positioning said flattened box kite atop said thread card;

wrapping said tails about said thread card;

providing a package slightly larger than said flat thread card; and inserting the flat thread card and flattened box kite into said package.

* * * * *